US012115617B2

(12) United States Patent
Carter et al.

(10) Patent No.: US 12,115,617 B2
(45) Date of Patent: Oct. 15, 2024

(54) BELT SANDER

(71) Applicant: The Boeing Company, Chicago, IL (US)

(72) Inventors: Duronte Carter, San Antonio, TX (US); Zachary J. Stephenson, West Richland, WA (US); Jose Gregorio Martinez, Puyallup, WA (US); Soren Mortvedt, Tacoma, WA (US); Michael A. Glidden, Auburn, WA (US); Kevin Bell, Maple Valley, WA (US); Matthew S. Carlin, Tacoma, WA (US); Davin Phillips, Logan, UT (US)

(73) Assignee: The Boeing Company, Chicago, IL (US)

( * ) Notice: Subject to any disclaimer, the term of this patent is extended or adjusted under 35 U.S.C. 154(b) by 339 days.

(21) Appl. No.: 17/538,185

(22) Filed: Nov. 30, 2021

(65) Prior Publication Data

US 2022/0331929 A1 Oct. 20, 2022

Related U.S. Application Data

(60) Provisional application No. 63/175,526, filed on Apr. 15, 2021.

(51) Int. Cl.
*B24B 23/06* (2006.01)
*B24B 21/16* (2006.01)
(Continued)

(52) U.S. Cl.
CPC ..... *B24B 23/06* (2013.01); *B24B 21/16* (2013.01); *B24B 21/20* (2013.01); *B24B 23/022* (2013.01);
(Continued)

(58) Field of Classification Search
CPC ..... B24B 21/002; B24B 21/006; B24B 21/04; B24B 21/10; B24B 21/12; B24B 21/14;
(Continued)

(56) References Cited

U.S. PATENT DOCUMENTS 3,665,650 A * 5/1972 Przygocki ..... B24B 21/18 451/1
3,745,717 A * 7/1973 Robinson ..... F15C 4/00 451/1
(Continued)

FOREIGN PATENT DOCUMENTS

GB 2334468 A * 8/1999 ..... B24B 21/20
WO WO-2008110027 A1 * 9/2008 ..... B24B 21/20

*Primary Examiner* — Eileen P Morgan
(74) *Attorney, Agent, or Firm* — Quinn IP Law

(57) ABSTRACT

A belt sander includes a frame, a drive roller, an idler roller rotatably attached to a pivot arm, a first linear actuator configured for pivoting the pivot arm, a nose roller and a continuous abrasive belt wrapped around the drive roller, the idler roller and the nose roller. A drive motor rotates the drive roller, and an air cylinder attached to the frame and a nose roller spindle exerts a first force against the frame and a second force equal to and opposite the first force against the nose roller spindle. A first sensor senses a position of a belt edge, and a first controller receives a belt edge position signal from the first sensor and sends a command signal responsive to the position signal to the first linear actuator for expanding or contracting so as to pivot the pivot arm about a pivot point.

20 Claims, 12 Drawing Sheets

(51) Int. Cl.

| | |
|---|---|
| ***B24B 21/20*** | (2006.01) |
| ***B24B 23/02*** | (2006.01) |
| ***B24B 41/04*** | (2006.01) |
| ***B24B 47/12*** | (2006.01) |
| ***B24B 49/12*** | (2006.01) |

(52) U.S. Cl.
CPC ..... *B24B 41/04* (2013.01); *B24B 47/12* (2013.01); *B24B 49/12* (2013.01)

(58) Field of Classification Search
CPC ..... B24B 21/16; B24B 21/165; B24B 21/20; B24B 23/022; B24B 23/06; B24B 41/04; B24B 47/12; B24B 49/00; B24B 49/10; B24B 49/12
USPC ..... 451/5, 6, 9, 10, 11, 12, 59, 296, 297, 451/303, 311, 355
See application file for complete search history.

(56) References Cited

U.S. PATENT DOCUMENTS

| | | | | |
|---|---|---|---|---|
| 3,900,973 | A * | 8/1975 | van der Linden | B24B 21/18 451/300 |
| 4,337,598 | A * | 7/1982 | Barth | B24B 21/18 451/526 |
| 5,184,424 | A * | 2/1993 | Miller | B24B 21/20 451/489 |
| 5,871,390 | A * | 2/1999 | Pant | B24B 21/20 451/41 |
| 6,899,594 | B1 * | 5/2005 | Charatan | B24B 21/20 451/41 |
| 10,427,270 | B2 | 10/2019 | Johnson et al. | |
| 2007/0259608 | A1 * | 11/2007 | Bechtold | B24B 41/04 451/303 |
| 2009/0149119 | A1 * | 6/2009 | Ahti | B25J 9/1679 451/296 |
| 2022/0331929 | A1 * | 10/2022 | Carter | B24B 41/04 |

* cited by examiner

BELT SANDER

CROSS-REFERENCE TO RELATED APPLICATIONS

This application claims priority to, and the benefit of, U.S. Provisional Patent Application No. 63/175,526 filed Apr. 15, 2021, which is hereby incorporated by reference in its entirety.

This disclosure relates generally to belt sanders, and more particularly to belt sanders having three rollers for supporting a continuous abrasive belt.

INTRODUCTION

FIG. 1 shows a rearward-looking perspective view of an aircraft empennage 10, showing the horizontal stabilizers 14 and the vertical stabilizer 12 and their respective leading edge portions 15. As part of the manufacturing and assembly process for the empennage 10, the leading edge portions 15 are placed in a fixture 16 and are sanded or polished using a conventional belt sander 17 carried on the end effector 18 of an industrial robot 19, as illustrated in FIG. 2. The belt sander 17 typically has two rollers 11 spaced apart which support a continuous sanding belt 13, with one of the rollers 11 being driven by a motor so that the belt 13 circulates around the two rollers 11.

FIG. 2 shows a perspective view of a belt sander 17 being used to sand the interior of a leading edge portion 15, and FIG. 3 shows a schematic partial cross-sectional view of the sander 17 and the leading edge portion 15. With the belt 13 moving at high speed and being pressed against the surface of the leading edge portion 15, and with the sander 17 being moved up and down and left and right across the surface, certain issues may arise during the sanding process. One issue may be referred to as "linear compliance", denoted by the double-arrow 7 in FIGS. 2-3 which points along the belt 13 between the two rollers 11. Linear compliance refers to how well pressure is maintained between the bottom roller 11 (and the belt 13 rolling around it) and the surface of the leading edge portion 15. This contact pressure is controlled by the positioning of the robot's end effector 18, and may vary over time due to the contours of the leading edge portion 15 and the positioning and movement of the end effector 18. Another issue may be referred to as "belt wander", denoted by the double-arrow 8 in FIG. 2 which points left and right across (perpendicular to) the belt 13. Belt wander refers to the tendency of the belt 13 to move to the left or the right across the rollers 11, rather than remaining centered across each roller 11. This wandering of the belt 13 is often caused by there being more pressure on one side of the bottom roller 11 than on the other side, due to contact between the bottom roller 11 (and the belt 13 rolling around it) and the surface contours of the leading edge portion 15. And yet another issue may be referred to as "radial compliance", denoted by the attack angle 9 between the belt 13 and the surface of the leading edge portion 15 in FIG. 3. Since the orientation of the belt sander 17 is typically fixed with respect to the orientation of the end effector 18 (as represented by the angle 5 between the axes of the end effector 18 and the sander 17 in FIG. 3), this means the attack angle 9 is determined solely by the positioning and movement of the end effector 18, which requires precise and constant movement of the end effector 18.

These issues of linear compliance, belt wander and radial compliance can cause increased or uneven belt wear, non-uniform sanding of the leading edge portion 15 and other challenges.

SUMMARY

According to one embodiment, a belt sander includes: (i) a frame; (ii) a drive roller rotatably supported by a drive roller spindle fixedly or rotatably attached to the frame, the drive roller having a drive roller axis about which the drive roller is configured to rotate; (iii) an idler roller rotatably supported by an idler roller spindle fixedly or rotatably attached to a pivot arm having opposed first and second pivot arm ends, wherein the first pivot arm end is pivotably attached to the frame at a pivot point; (iv) a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths; and (v) a nose roller rotatably supported by a nose roller spindle fixedly or rotatably attached to the frame.

A continuous abrasive belt is wrapped around and is held in tension by the drive roller, the idler roller and the nose roller. A drive motor is attached to the frame and is operatively connected with the drive roller for rotating the drive roller about the drive roller axis and propelling the continuous abrasive belt around the drive roller, the idler roller and the nose roller during an operating state. An air cylinder has a first air cylinder end attached to the frame and a second air cylinder end attached to the nose roller spindle, with the air cylinder being configured to exert a first force against the frame and a second force equal to and opposite the first force against the nose roller spindle. At least one first sensor is attached to the frame and is configured to sense a position of an edge of the continuous abrasive belt. A first controller is operatively connected with the at least one first sensor and the first linear actuator and is configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point. Optionally, the belt sander may further include a lubricant dispenser attached to the frame and configured to spray a lubricant onto an outer surface of the continuous abrasive belt.

The belt sander may further include: an attachment interface having a main body with opposed first and second sides, the first side being configured for connection with an end effector of a robot and the second side having a cylindrical member extending outward therefrom and rotatably supporting the frame; and a second linear actuator having a third end attached to the frame and a fourth end attached to the main body, wherein the second linear actuator is configured for expanding a second distance as measured between the third and fourth ends up to a second maximum length and contracting the second distance down to a second minimum length. In this configuration, the expanding of the second distance may cause rotation of the frame about the cylindrical member in a first rotational direction, and the contracting of the second distance may cause rotation of the frame about the cylindrical member in a second rotational direction opposite the first rotational direction.

The idler roller may have an idler roller axis about which the idler roller is configured to rotate, the nose roller may have a nose roller axis about which the nose roller is configured to rotate, and the drive roller axis, the idler roller axis and the nose roller axis may be parallel with each other and may not all lie within the same plane. An optimal running path for the continuous abrasive belt may be defined as a path around the drive roller, the idler roller and the nose roller in which the continuous abrasive belt is generally centered across each of the drive roller, the idler roller and the nose roller. The expanding of the first distance may cause pivoting of the pivot arm about the pivot point in a first pivot direction, which urges the continuous abrasive belt to slip in a first slip direction toward a first idler roller end of the idler roller, and the contracting of the first distance may cause pivoting of the pivot arm about the pivot point in a second pivot direction opposite the first pivot direction, which urges the continuous abrasive belt to slip in a second slip direction toward a second idler roller end of the idler roller opposite the first idler roller end. The at least one first sensor may be disposed so as to sense the position of the edge of the continuous abrasive belt proximate the idler roller, and the at least one first sensor may be at least one fiber optic laser sensor. An outer surface of the abrasive belt may be coated with 120-grit diamond particles or other suitable abrasive particles.

According to another embodiment, a belt sander includes: an attachment interface having a main body with opposed first and second sides, the first side being configured for connection with an end effector of a robot and the second side having a cylindrical member extending outward therefrom; a frame rotatably supported by the cylindrical member; a drive roller rotatably supported by a drive roller spindle fixedly or rotatably attached to the frame, the drive roller having a drive roller axis about which the drive roller is configured to rotate; an idler roller rotatably supported by an idler roller spindle fixedly or rotatably attached to a pivot arm having opposed first and second pivot arm ends, wherein the first pivot arm end is pivotably attached to the frame at a pivot point; a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths; a nose roller rotatably supported by a nose roller spindle fixedly or rotatably attached to the frame; a continuous abrasive belt wrapped around and held in tension by the drive roller, the idler roller and the nose roller; a drive motor attached to the frame and operatively connected with the drive roller for rotating the drive roller about the drive roller axis and propelling the continuous abrasive belt around the drive roller, the idler roller and the nose roller during an operating state; an air cylinder having a first air cylinder end attached to the frame and a second air cylinder end attached to the nose roller spindle, the air cylinder being configured to exert a first force against the frame and a second force equal to and opposite the first force against the nose roller spindle; at least one first sensor attached to the frame and configured to sense a position of an edge of the continuous abrasive belt; a first controller operatively connected with the at least one first sensor and the first linear actuator and configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point; and a second linear actuator having a third end attached to the frame and a fourth end attached to the main body, wherein the second linear actuator is configured for expanding a second distance as measured between the third and fourth ends up to a second maximum length and contracting the second distance down to a second minimum length.

In this configuration, the expanding of the second distance may cause rotation of the frame about the cylindrical member in a first rotational direction, and the contracting of the second distance may cause rotation of the frame about the cylindrical member in a second rotational direction opposite the first rotational direction. The idler roller may have an idler roller axis about which the idler roller is configured to rotate, the nose roller may have a nose roller axis about which the nose roller is configured to rotate, and the drive roller axis, the idler roller axis and the nose roller axis may be parallel with each other and may not all lie within the same plane. An optimal running path for the continuous abrasive belt may be defined as a path around the drive roller, the idler roller and the nose roller in which the continuous abrasive belt is generally centered across each of the drive roller, the idler roller and the nose roller, and the at least one first sensor may be disposed so as to sense the position of the edge of the continuous abrasive belt proximate the idler roller. The expanding of the first distance may cause pivoting of the pivot arm about the pivot point in a first pivot direction, which urges the continuous abrasive belt to slip in a first slip direction toward a first idler roller end of the idler roller, and the contracting of the first distance may cause pivoting of the pivot arm about the pivot point in a second pivot direction opposite the first pivot direction, which urges the continuous abrasive belt to slip in a second slip direction toward a second idler roller end of the idler roller opposite the first idler roller end.

According to yet another embodiment, a belt sander includes: an attachment interface having a main body with opposed first and second sides, the first side being configured for connection with an end effector of a robot and the second side having a cylindrical member extending outward therefrom; a frame rotatably supported by the cylindrical member; a drive roller rotatably supported by a drive roller spindle fixedly or rotatably attached to the frame, the drive roller having a drive roller axis about which the drive roller is configured to rotate; an idler roller rotatably supported by an idler roller spindle fixedly or rotatably attached to a pivot arm having opposed first and second pivot arm ends, wherein the first pivot arm end is pivotably attached to the frame at a pivot point; a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths, wherein the expanding of the first distance causes pivoting of the pivot arm about the pivot point in a first pivot direction, which urges the continuous abrasive belt to slip in a first slip direction toward a first idler roller end of the idler roller, and the contracting of the first distance causes pivoting of the pivot arm about the pivot point in a second pivot direction opposite the first pivot direction, which urges the continuous abrasive belt to slip in a second slip direction toward a second idler roller end of the idler roller opposite the first idler roller end; a nose roller rotatably supported by a nose roller spindle fixedly or rotatably attached to the frame; and a continuous abrasive belt wrapped around and held in tension by the drive roller, the idler roller and the nose roller.

A drive motor is attached to the frame and is operatively connected with the drive roller for rotating the drive roller about the drive roller axis and propelling the continuous abrasive belt around the drive roller, the idler roller and the nose roller during an operating state. An air cylinder has a first air cylinder end attached to the frame and a second air cylinder end attached to the nose roller spindle, the air cylinder being configured to exert a first force against the frame and a second force equal to and opposite the first force against the nose roller spindle. At least one first sensor is attached to the frame and is configured to sense a position of an edge of the continuous abrasive belt. A first controller is operatively connected with the at least one first sensor and the first linear actuator and is configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point. A second linear actuator has a third end attached to the frame and a fourth end attached to the main body, wherein the second linear actuator is configured for expanding a second distance as measured between the third and fourth ends up to a second maximum length and contracting the second distance down to a second minimum length, wherein the expanding of the second distance causes rotation of the frame about the cylindrical member in a first rotational direction, and the contracting of the second distance causes rotation of the frame about the cylindrical member in a second rotational direction opposite the first rotational direction.

The idler roller may have an idler roller axis about which the idler roller is configured to rotate, the nose roller may have a nose roller axis about which the nose roller is configured to rotate, and the drive roller axis, the idler roller axis and the nose roller axis may be parallel with each other and may not all lie within the same plane. An optimal running path for the continuous abrasive belt may be defined as a path around the drive roller, the idler roller and the nose roller in which the continuous abrasive belt is generally centered across each of the drive roller, the idler roller and the nose roller, and the at least one first sensor may be disposed so as to sense the position of the edge of the continuous abrasive belt proximate the idler roller.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

Figure 1:
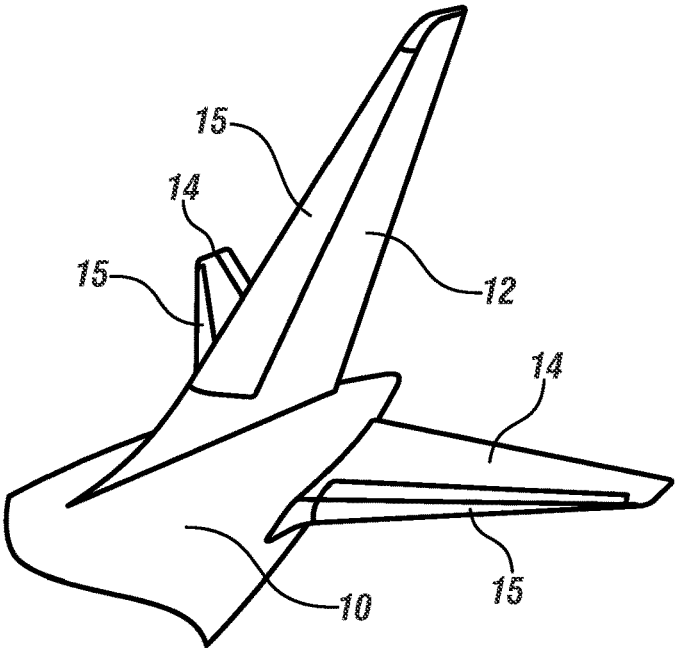
FIG. 1 is a rearward-looking perspective view of an empennage of an aircraft, showing leading edges of the horizontal and vertical stabilizers.

Referring now to the drawings, wherein like numerals indicate like parts in the several views, a belt sander 20 is shown and described herein. Note that certain reference numerals in the drawings have subscripts, such as the four first sensors $\mathbf{54}_{Li}$, $\mathbf{54}_{Lo}$, $\mathbf{54}_{Ri}$ and $\mathbf{54}_{Ro}$ of FIGS. 8-10. Subscripts are used in the drawings and in the present description to refer to individual elements (such as the aforementioned first sensors), while the use of reference numerals without subscripts may refer to the collective group of such elements and/or to a singular but generic one of such elements. Thus, reference numeral $\mathbf{54}_{Li}$ refers to a specific first sensor, while reference numeral 54 (without the subscript) may refer to all the first sensors, the group of first sensors, or a singular but generic first sensor (i.e., any first sensor).

Figure 2:
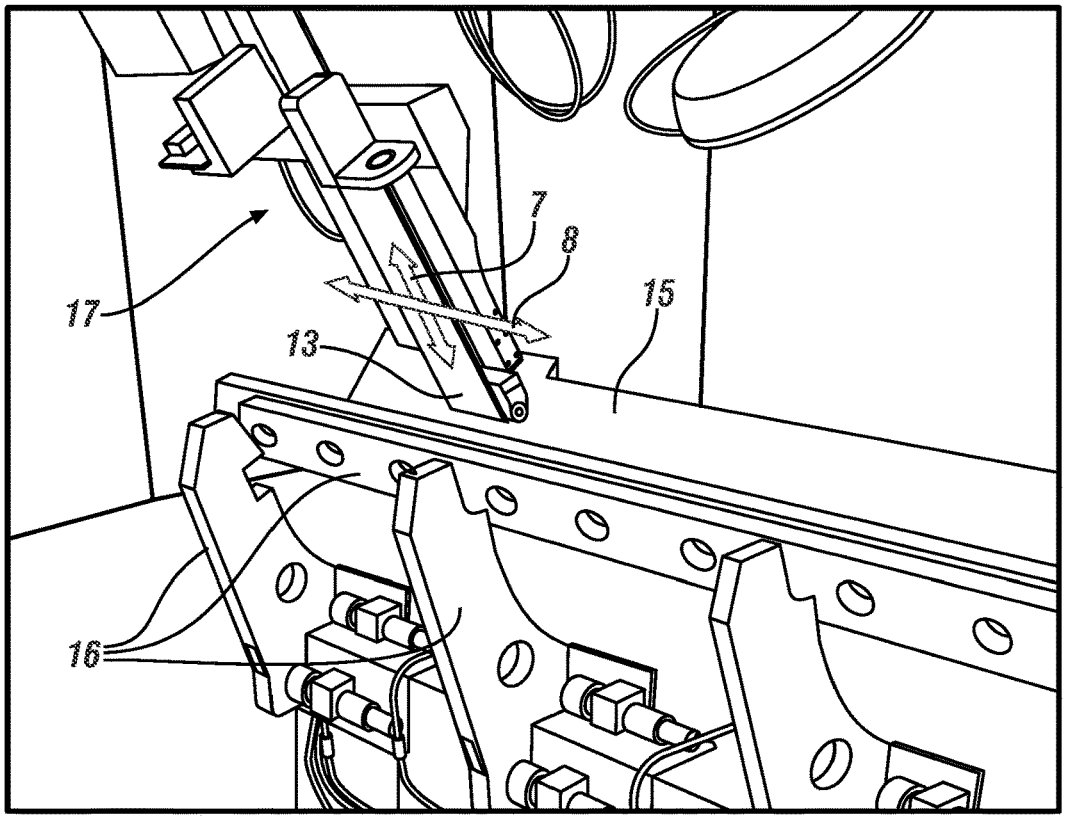
FIG. 2 is perspective view of a conventional belt sander sanding the interior of a leading edge workpiece.
Figure 3:
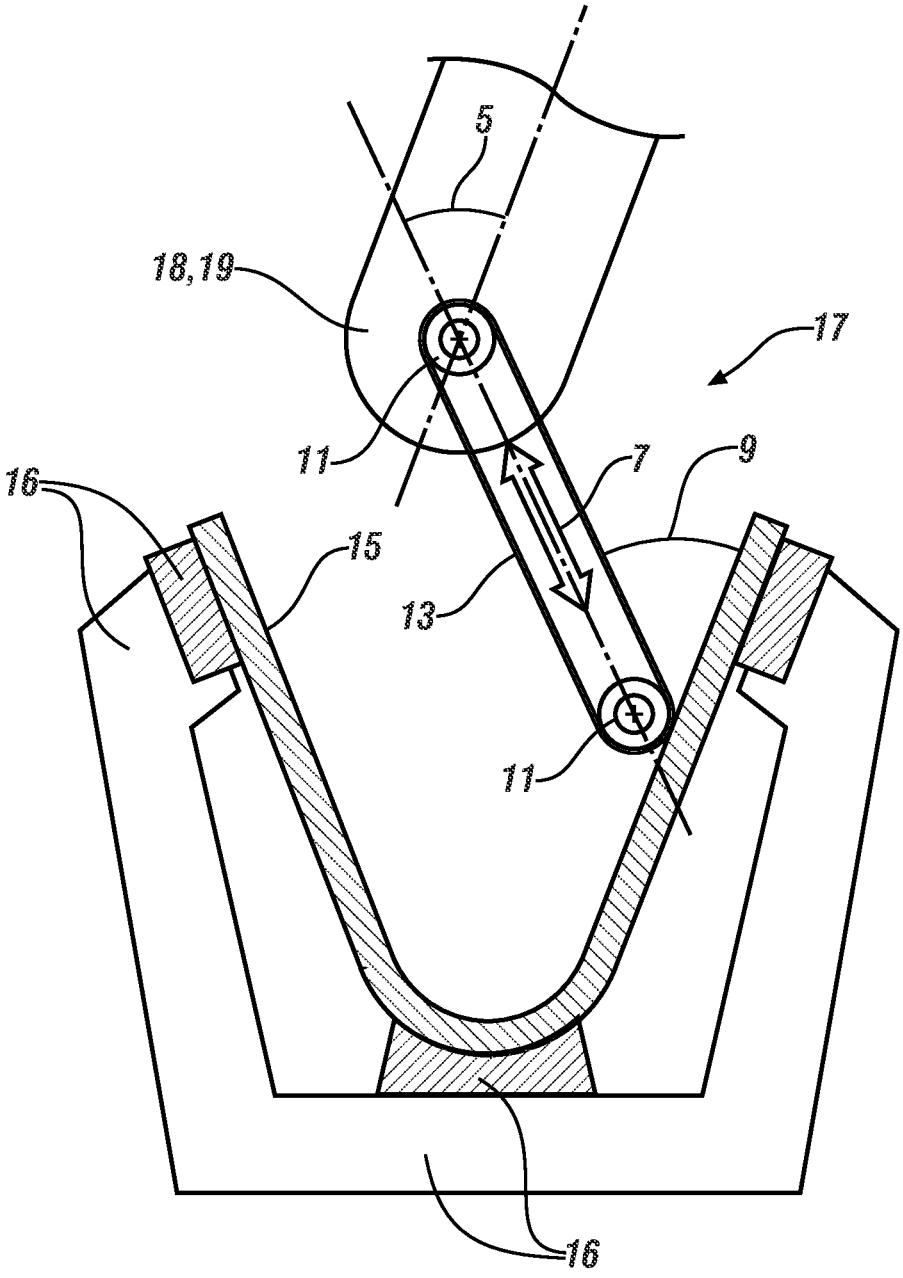
FIG. 3 is a schematic partial cross-sectional view of the conventional belt sander and leading edge workpiece of FIG. 2.
Figure 4:
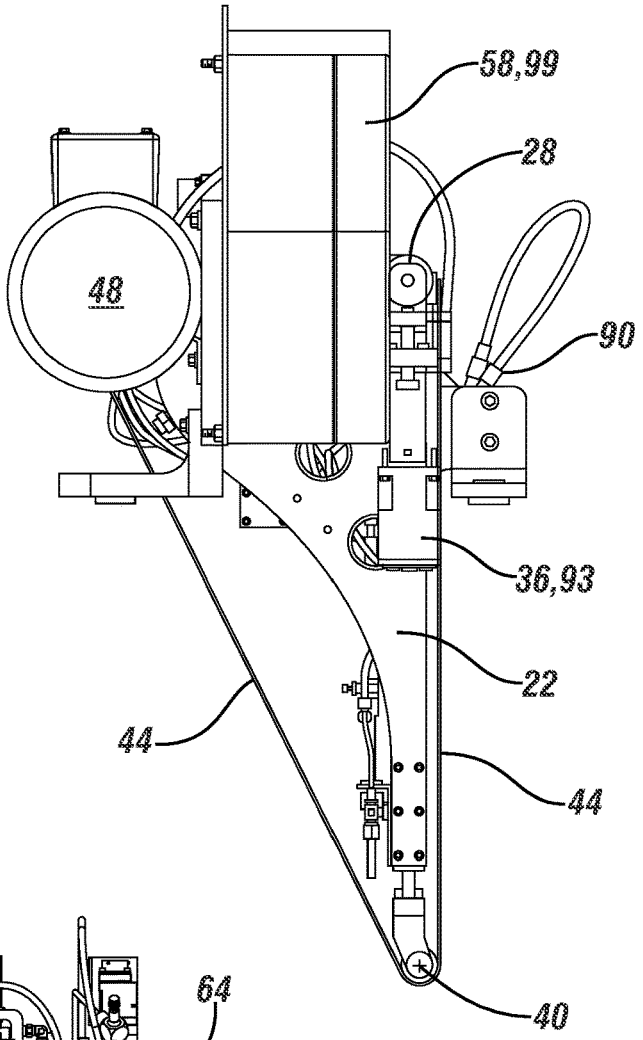
FIGS. 4-7 are right side, front, left side and top views, respectively, of the belt sander.
Figure 5:
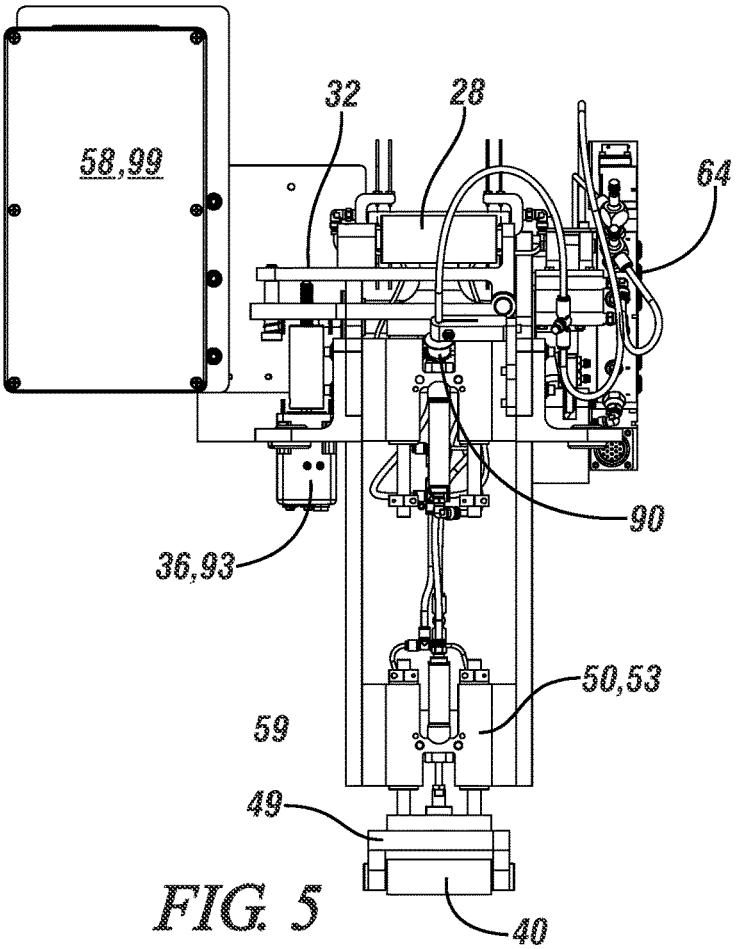
Figure 6:
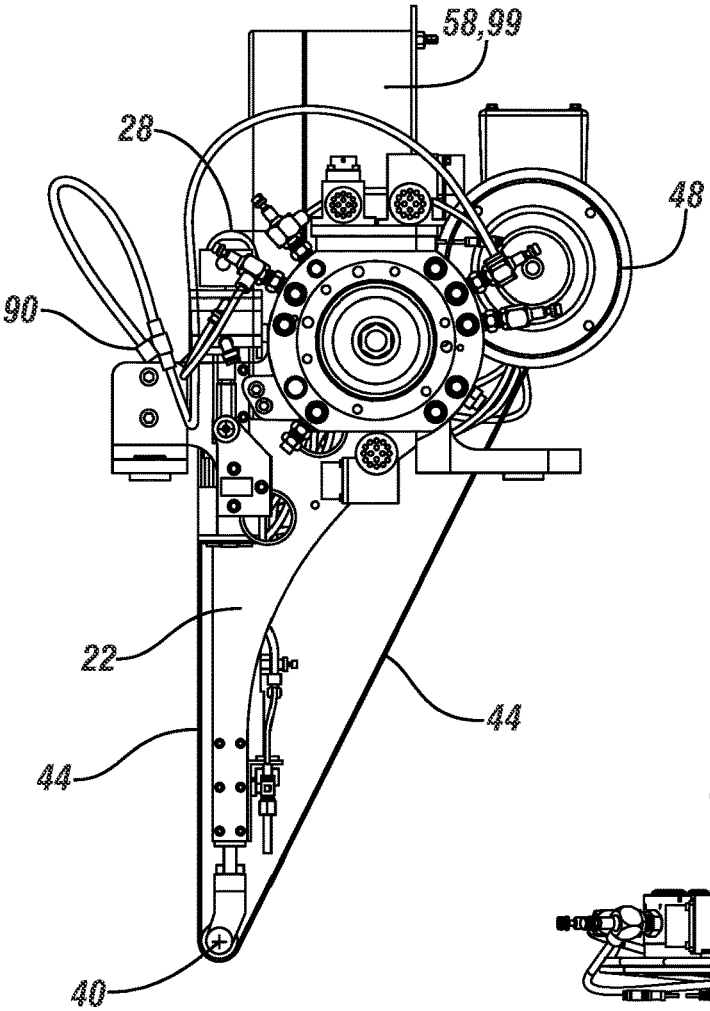
Figure 7:
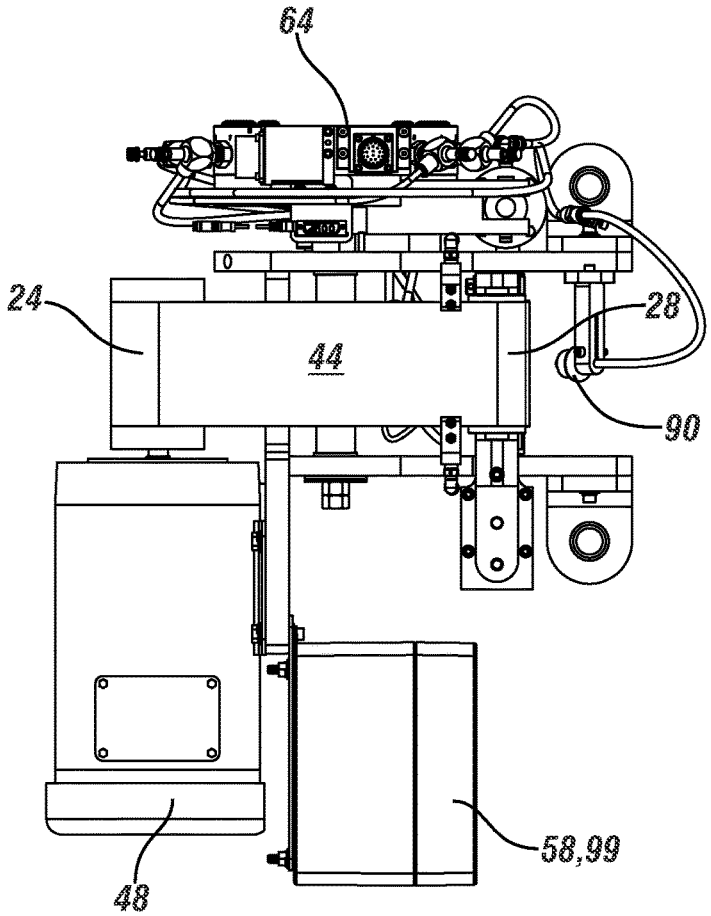
Figure 23:
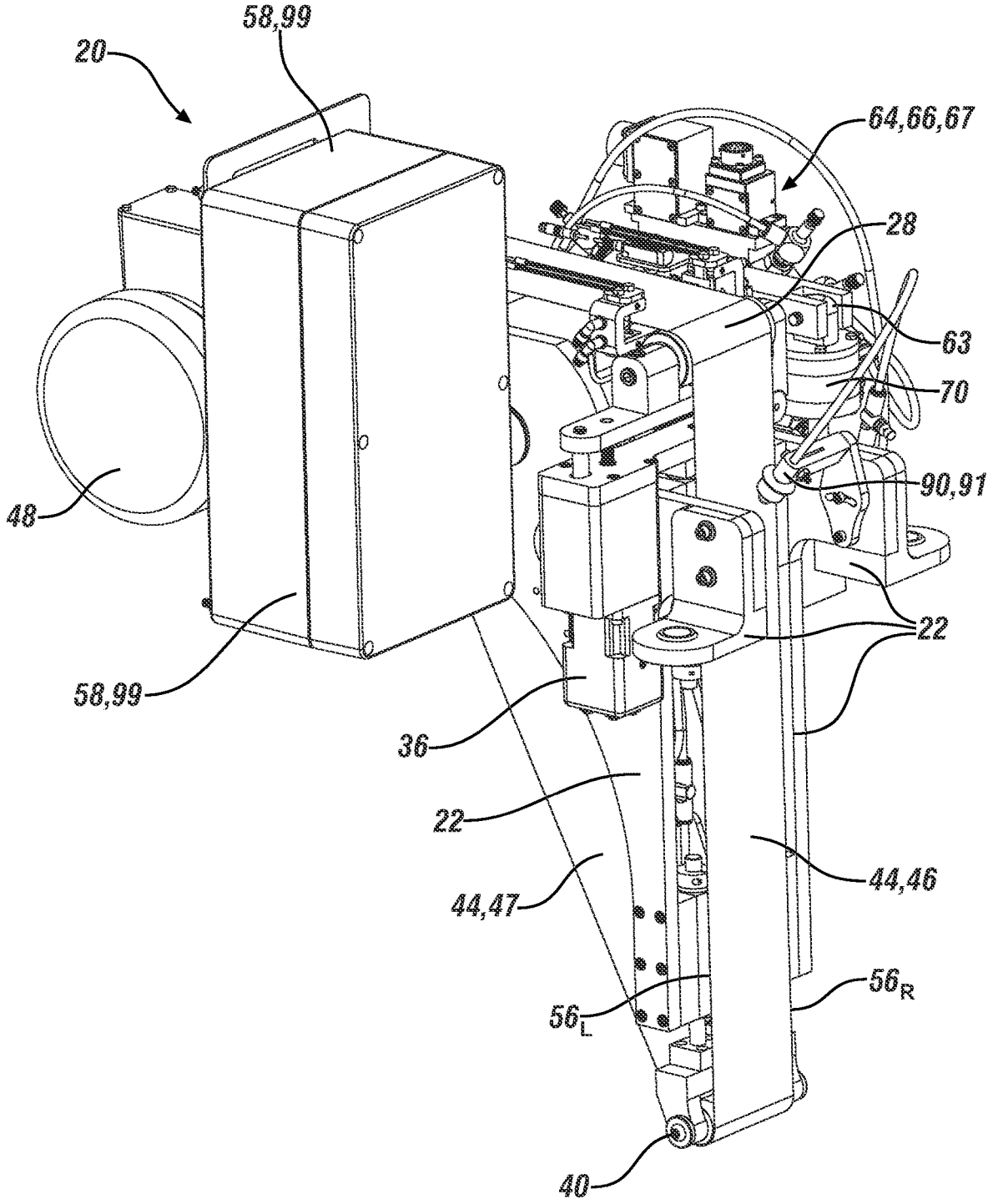
FIG. 23 is a front right-side perspective view of the belt sander.
Figure 24:
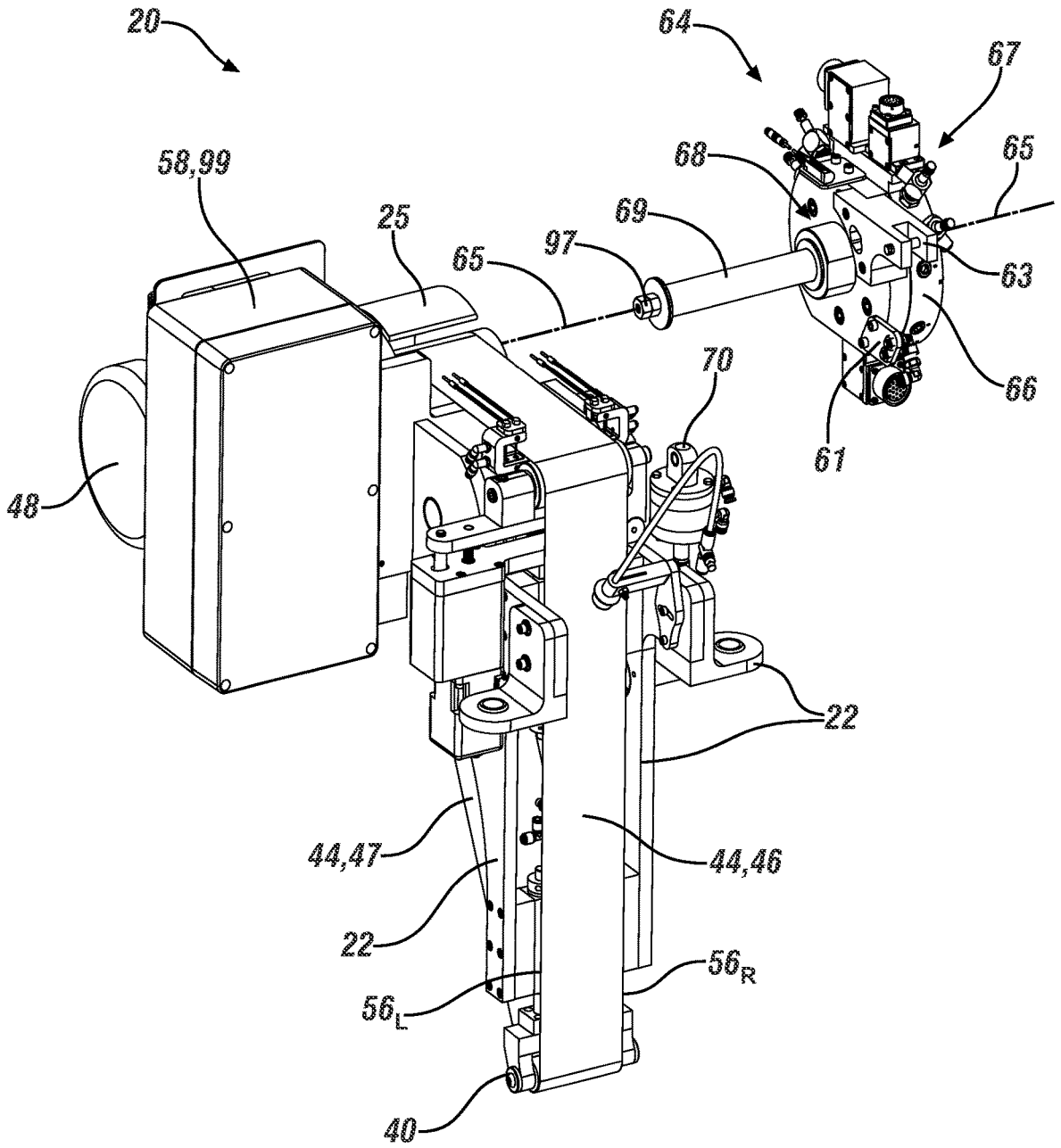
FIG. 24 is a front right-side perspective exploded view of the belt sander, showing the attachment interface separated.

The belt sander 20 of the present disclosure may be substituted for the conventional belt sander 17 shown in FIGS. 2-3, and may be used to sand or polish the interior and/or exterior surfaces of a leading edge portion 15 or other workpiece. This belt sander 20 is further shown in FIGS. 4-7 in respective right side, front, left side and top views, as well as in FIGS. 23-25 which shows various perspective views. Additionally, FIGS. 8-22 show certain details of the rollers 24, 28, 40 and associated hardware used in the belt sander 20, as described in further detail below.

Figure 8:
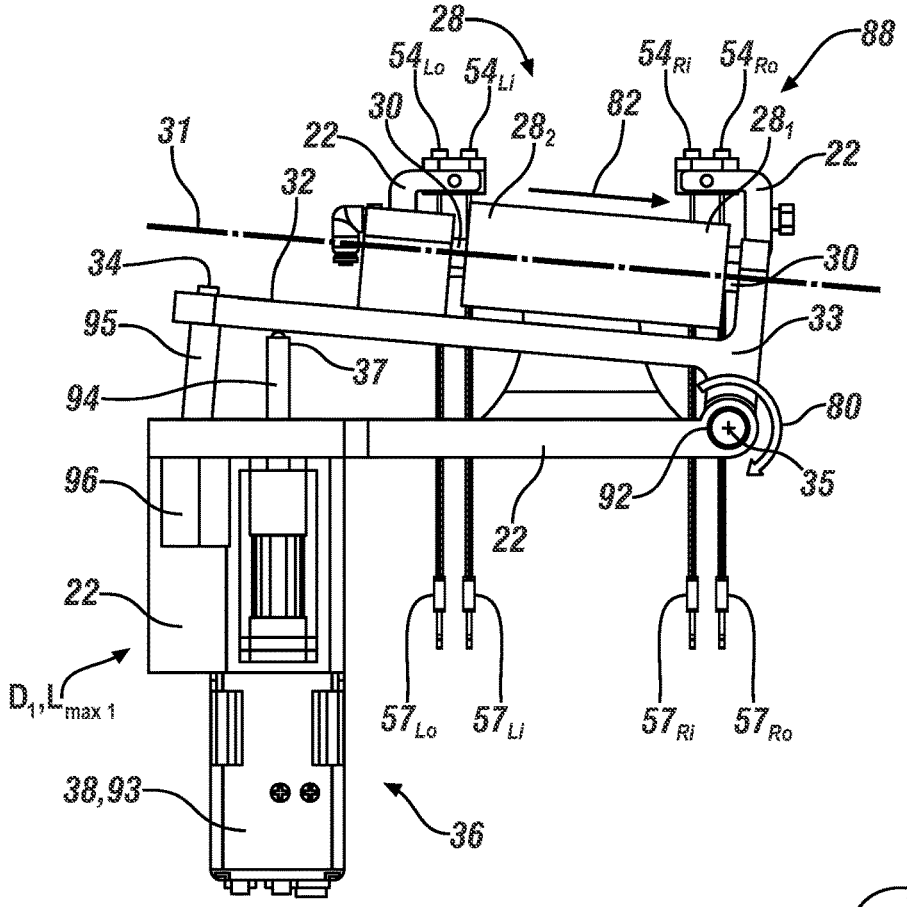
FIGS. 8-10 are schematic front close-up views of an idler roller, pivot arm and first linear actuator with the pivot arm disposed in a first pivot direction, a first default position and a second pivot direction, respectively.
Figure 9:
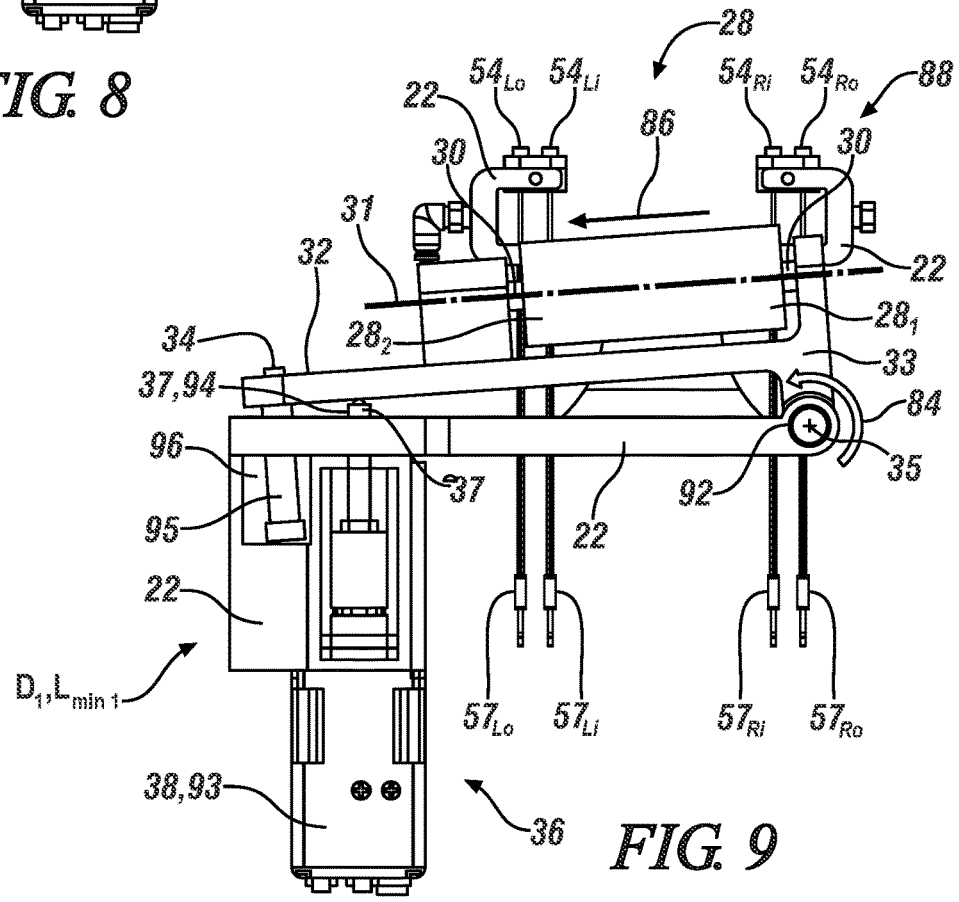
Figure 10:
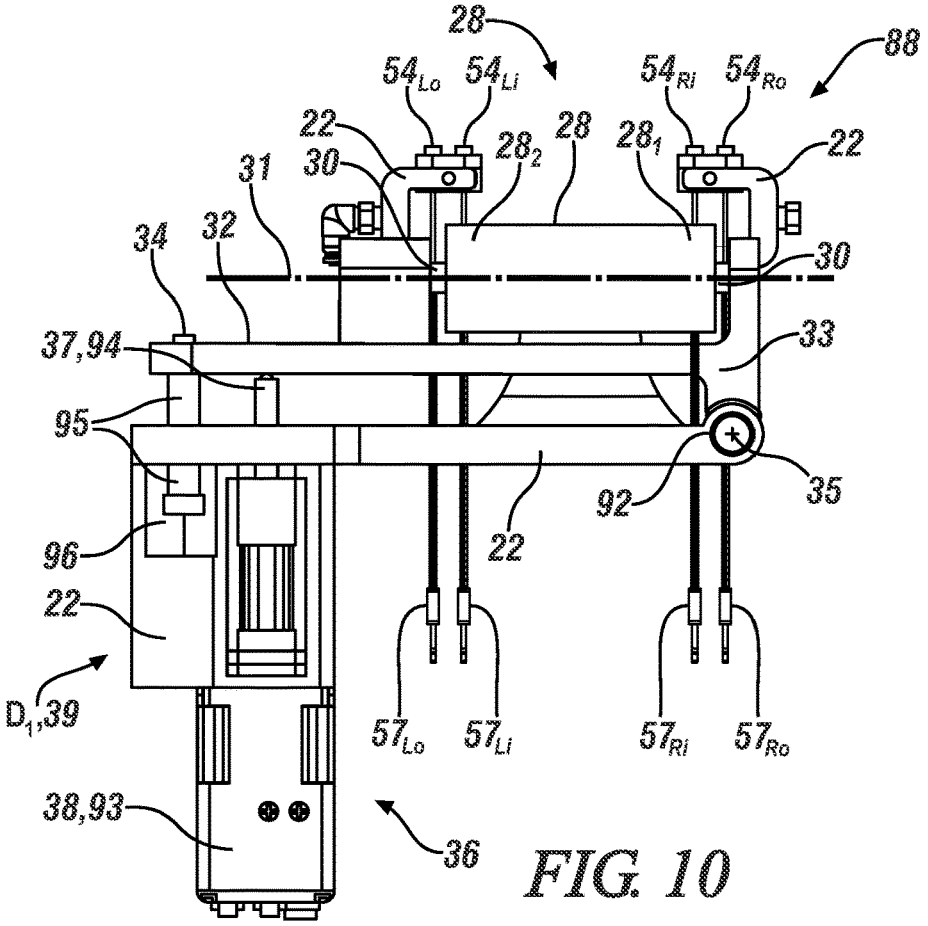

According to one embodiment, the belt sander 20 includes a mechanical housing or frame 22, a drive roller 24 rotatably supported by a drive roller spindle 26 that is fixedly or rotatably attached to the frame 22 (with the drive roller 24 having a drive roller axis 27 about which the drive roller 24 is configured to rotate), and an idler roller 28 rotatably supported by an idler roller spindle 30 that is fixedly or rotatably attached to a pivot arm 32. An optional shroud 25 may partially cover the drive roller 24. As shown in FIGS. 8-10, the pivot arm 32 has opposed first and second pivot arm ends 33, 34, with the first pivot arm end 33 being pivotably attached to the frame 22 at a pivot point 35, thus permitting the pivot arm 32 to rotate in a first pivot direction 80 (i.e., clockwise, as viewed in FIG. 8) and a second pivot direction 84 (i.e., counterclockwise, as viewed in FIG. 9) about the pivot point 35 which is opposite the first pivot direction 80. An optional guide member 95 may extend from the second pivot arm end 34 as shown, and may be received within an optional pocket 96 formed in the frame 22.

Figure 11:
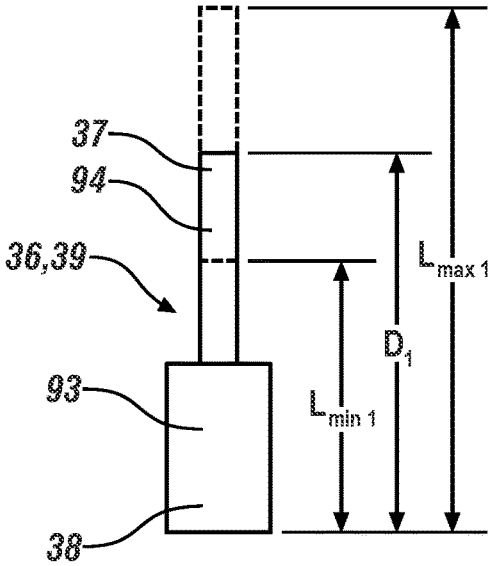
FIGS. 11-12 are schematic front views of first and second linear actuators, respectively, illustrating various lengths and distances associated with each actuator.

The belt sander 20 also includes a first linear actuator 36 having a first end 37 attached to the second pivot arm end 34, and a second end 38 attached to the frame 22. As illustrated in FIG. 11, the first linear actuator 36 is configured for expanding a first distance $D_1$—as measured between the first and second ends 37, 38—up to a first maximum length $L_{max1}$, and contracting the first distance $D_1$ down to a first minimum length $L_{min1}$, and for disposition in a first default position 39 in which the first distance $D_1$ is between the first minimum and maximum lengths $L_{min1}$, $L_{max1}$. As shown in FIG. 11, the first linear actuator 36 may include a first drive unit 93 (e.g., an electric motor or a hydraulic or pneumatic actuator) for linearly extending and retracting a first rod or shaft 94.

FIG. 10 shows the first linear actuator 36 disposed in the first default position 39, which causes the pivot arm 32 to be disposed in a level orientation. In comparison, FIG. 8 shows the first linear actuator 36 extended so as to expand the first distance $D_1$ toward the first maximum length $L_{max1}$, thereby causing the pivot arm 32 to pivot about the pivot point 35 (e.g., about a pivot pin 92) in the first pivot direction 80 (e.g., clockwise), and FIG. 9 shows the first linear actuator 36 retracted so as to contract the first distance $D_1$ toward the first minimum length $L_{min1}$, thereby causing the pivot arm 32 to pivot about the pivot point 35 (or pivot pin 92) in the second pivot direction 84 (e.g., counter-clockwise). The ability of the pivot arm 32 to pivot in this way enables a functionality that is described in further detail below.

The belt sander 20 further includes a nose roller 40 rotatably supported by a nose roller spindle 42 that is fixedly or rotatably attached to the frame 22, and a continuous abrasive belt 44 that is wrapped around and held in tension by the drive roller 24, the idler roller 28 and the nose roller 40. A drive motor 48 is attached to the frame 22 and is operatively connected with the drive roller 24 for rotating the drive roller 24 about the drive roller axis 27 and propelling the continuous abrasive belt 44 around the drive roller 24, the idler roller 28 and the nose roller 40 during an operating state 45 (e.g., when the drive motor 48 is driving the continuous abrasive belt 44 around the rollers 24, 28, 40).

Figure 13:
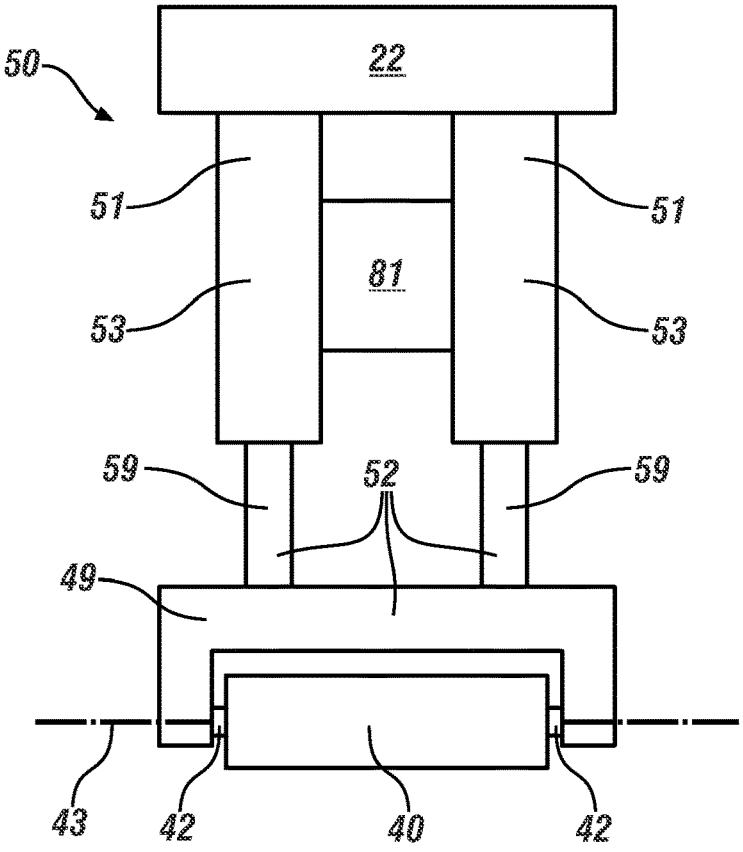
FIG. 13 is a schematic front view of the nose roller and air cylinder assembly.
Figure 14:
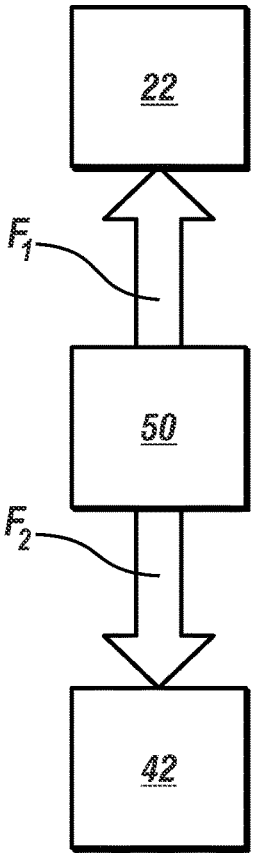
FIG. 14 is a block diagram illustrating the forces exerted by the air cylinder upon the frame and the nose roller spindle.

The belt sander 20 also includes one or more air cylinders 50 connecting the nose roller 40 to the frame 22, with each air cylinder 50 having a respective first air cylinder end 51 attached to the frame 22 and a respective second air cylinder end 52 attached directly or indirectly to the nose roller spindle 42. As illustrated by the schematic diagram of FIG. 13 and the block diagram of FIG. 14, two air cylinders 50 may be used in parallel, but it should be apparent that one air cylinder 50 or more than two air cylinders 50 may also be used. Collectively, the one or more air cylinders 50 are configured to exert a first force $F_1$ against the frame 22 and a second force $F_2$ equal to and opposite the first force $F_1$ against the nose roller spindle 42. As shown in FIG. 13, each air cylinder 50 may have an air cylinder body 53 which may be pressurized and set to a predetermined nominal air pressure, and an air cylinder shaft or rod 59 which is pushed outward from the air cylinder body 53 by the air pressure inside the air cylinder body 53. The air cylinder body 53 may be disposed at the first air cylinder end 51 and the air cylinder shaft/rod 59 may be disposed at the second air cylinder end 52, as illustrated in FIG. 13, or this orientation may be reversed. A brace 81 may be disposed between the air cylinders 50 to provide support therebetween, and may optionally be attached to each of the air cylinders 50. Each air cylinder shaft/rod 59 may be attached to an air cylinder yoke 49, which in turn may be configured to hold the nose roller spindle(s) 42 so as to permit the nose roller 40 to rotate about the nose roller axis 43. In this configuration, the air pressure in the one or more air cylinders 50 may be set so as to cause the nose roller 40 to exert a predetermined force or pressure against the continuous abrasive belt 44 and/or against the surface of the workpiece 15.

Figure 16:
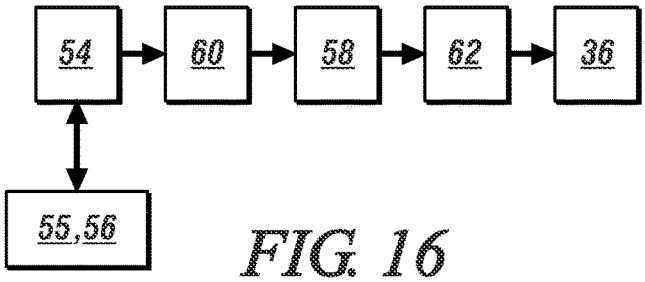
FIG. 16 is a block diagram illustrating signal and/or control interactions among the position of the belt edge, the first sensor(s) and the first linear actuator.

At least one first sensor 54 is attached to the frame 22 and is configured to sense a position 55 of an edge 56 of the continuous abrasive belt 44. For example, as shown in FIGS. 8-10, 18 and 20-22, four first sensors 54 may be used, with a first pair disposed near one edge 56 of the belt 44 and a second pair disposed near the other edge 56 of the belt 44. As illustrated in FIG. 16, a first controller 58 is operatively connected with the one or more first sensors 54 and the first linear actuator 36, and is configured to receive a position signal 60 from the first sensor(s) 54 indicative of the position 55 of the edge 56 of the continuous abrasive belt 44 and to send a command signal 62 responsive to the position signal 60 to the first linear actuator 36 for expanding or contracting the first distance $D_1$ so as to pivot the pivot arm 32 about the pivot point 35. The first controller 58 may be housed in an electrical enclosure or control box 99, which may be secured to the frame 22. Optionally, the belt sander 20 may further include a lubricant dispenser 90 attached to the frame 22, which is configured to spray a lubricant 91 (e.g., water) onto an outer surface 46 of the continuous abrasive belt 44.

Figure 12:
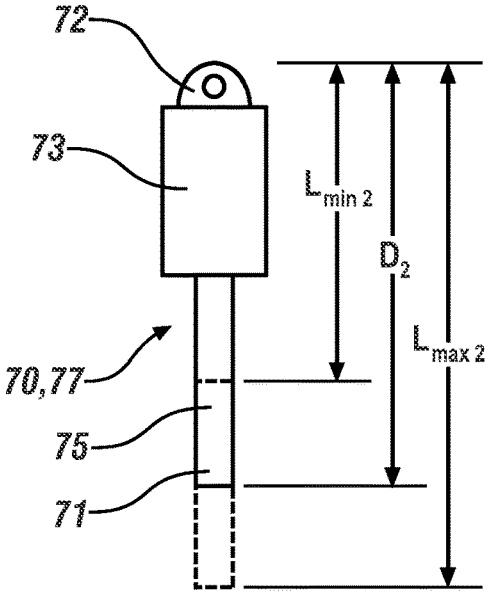
Figure 25:
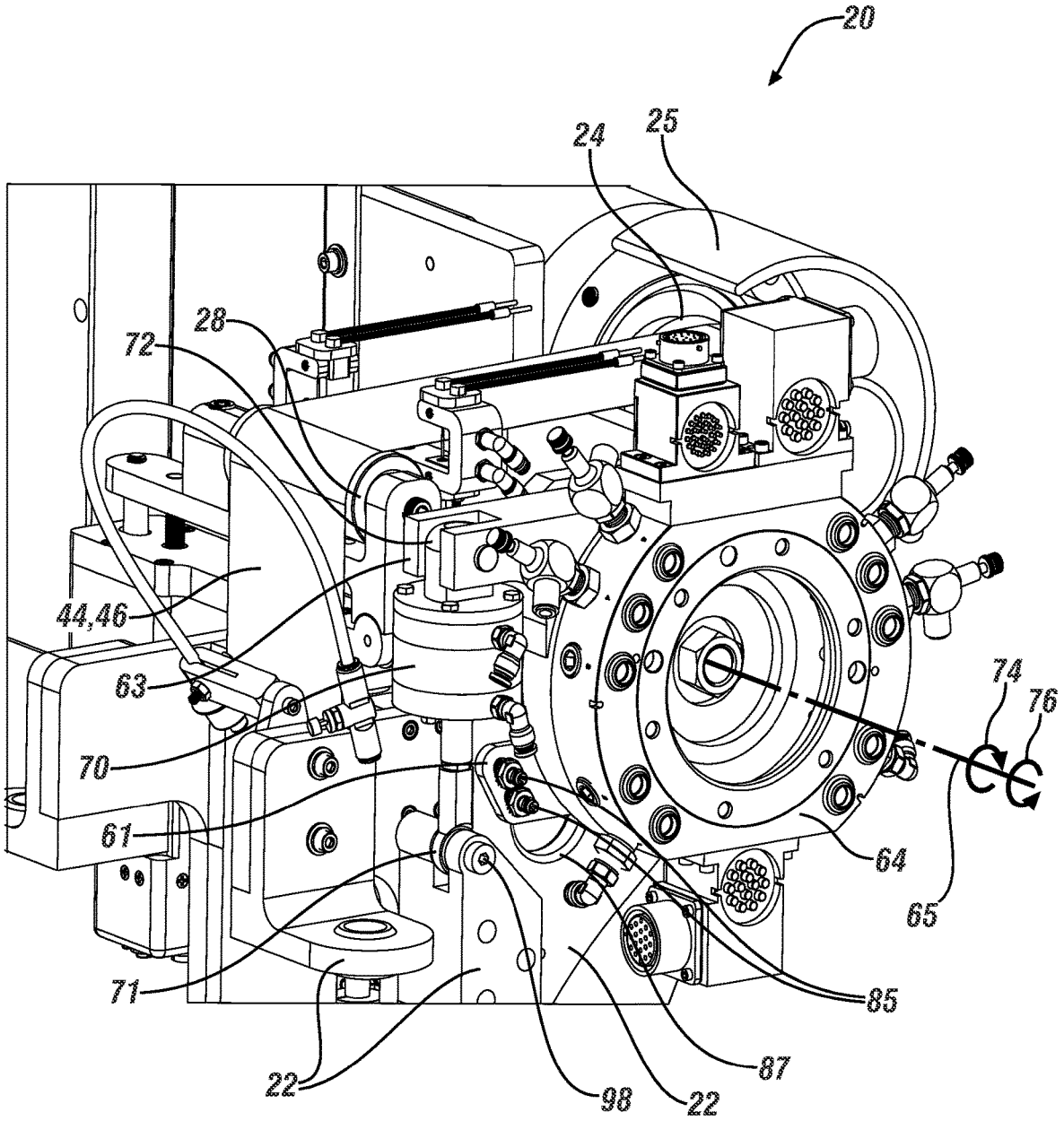
FIG. 25 is a front left-side perspective close-up view of the belt sander, showing the attachment interface attached.

The belt sander 20 may further include an attachment interface 64 having a main body 66 with opposed first and second sides 67, 68, with the first side 67 being configured for connection with an end effector 18 of a robot 19, and the second side 68 having a cylindrical member 69 extending outward from the second side 68 of the main body 66 and configured to rotatably support the frame 22. The cylindrical member 69 defines a cylindrical member axis 65, and may be threaded at the end distal from the main body 66 for receiving a washer and nut 97 or other suitable fastener thereon. As shown in FIGS. 12 and 25, a second linear actuator 70 has a third end 71 attached to the frame 22 (e.g., via a yoke and pin combination 98) and a fourth end 72 attached to the main body 66 (e.g., via another yoke and pin combination 63), wherein the second linear actuator 70 is configured for expanding a second distance $D_2$—as measured between the third and fourth ends 71, 72—up to a second maximum length $L_{max2}$, and contracting the second distance $D_2$ down to a second minimum length $L_{min2}$, and for disposition in a second default position 77 in which the second distance $D_2$ is between the second minimum and maximum lengths $L_{min2}$, $L_{max2}$. In this configuration, the expanding of the second distance $D_2$ causes rotation of the frame 22 about the cylindrical member 69 in a first rotational direction 74, and the contracting of the second distance $D_2$ causes rotation of the frame 22 about the cylindrical member 69 in a second rotational direction 76 opposite the first rotational direction 74. The second linear actuator 70 may include a second drive unit 73 (e.g., an electric motor or a hydraulic or pneumatic actuator) for linearly extending and retracting a second rod or shaft 75.

Figure 15:
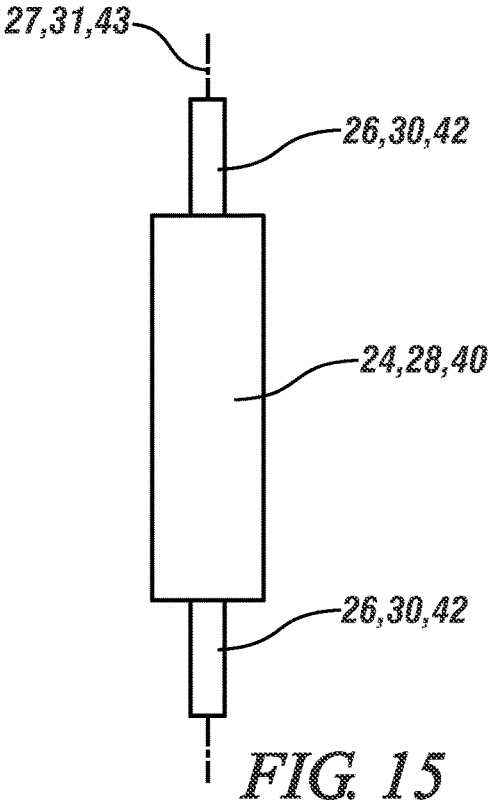
FIG. 15 is a schematic top view of a generalized roller and its spindles, which may be representative of each of the driver roller, the idler roller and the nose roller.
Figure 17:
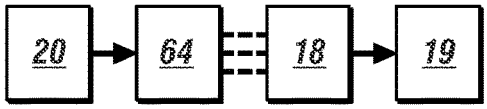
FIG. 17 is a block diagram illustrating a connection of the belt sander to an end effector of a robot via the attachment interface.
Figure 19:
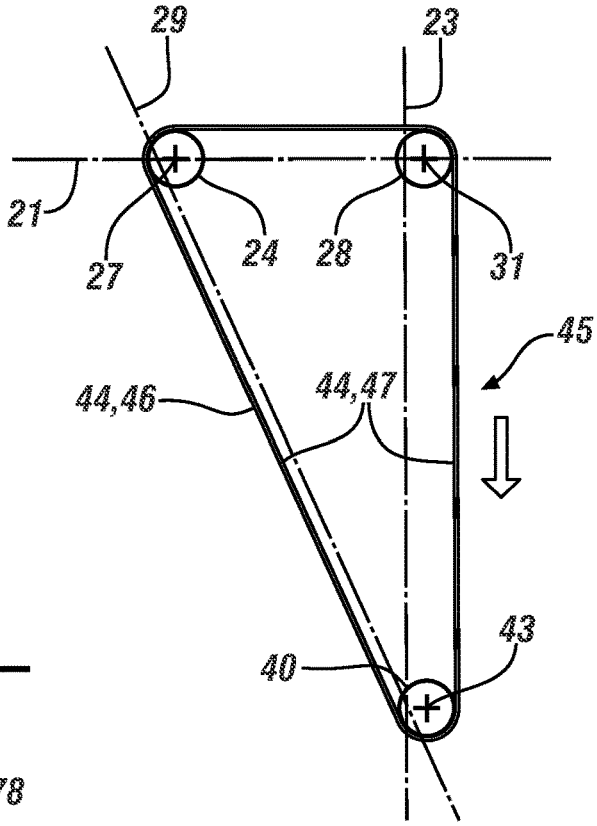
FIGS. 18-19 are schematic front and right-side views, respectively, of the rollers and continuous belt of the belt sander.

As illustrated in FIGS. 15 and 19, each roller 24, 28, 40 has at least one respective spindle 26, 30, 42 which defines a respective roller axis 27, 31, 43. That is, the drive roller 24 has at least one drive roller spindle 26 and a drive roller axis 27 about which the drive roller 24 is configured to rotate, the idler roller 28 has at least one idler roller spindle 30 and an idler roller axis 31 about which the idler roller 28 is configured to rotate, and the nose roller 40 has at least one nose roller spindle 42 and a nose roller axis 43 about which the nose roller 40 is configured to rotate. For each roller 24, 28, 40, a single respective spindle 26, 30, 42 may extend therethrough, or two respective spindles 26, 30, 42 (e.g., half-spindles) may extend through and/or out from the roller 24, 28, 40. Each roller 24, 28, 40 and its respective spindle(s) 26, 30, 42 may be formed as a single piece, in which case each roller 24, 28, 40 and its spindle(s) 26, 30, 42 would rotate at the same angular velocity as each other. Alternatively, each roller 24, 28, 40 may be formed as a separate piece from its respective spindle(s) 26, 30, 42, in which case each roller 24, 28, 40 may be assembled with its respective spindle(s) 26, 30, 42 and the resulting assembly may either be "locked" (such that each roller 24, 28, 40 and its spindle(s) 26, 30, 42 would rotate at the same angular velocity as each other) or "free-rolling" (such that each roller 24, 28, 40 is free to rotate at a different angular velocity from its spindle(s) 26, 30, 42, such as by bearings or bearing surfaces being disposed between the roller 24, 28, 40 and its spindle(s) 26, 30, 42).

The rollers 24, 28, 40 may be disposed in a triangular arrangement (as viewed from the left and right sides of the belt sander 20, such as shown in the right-side view of FIG. 19), such that the drive roller axis 27, the idler roller axis 31 and the nose roller axis 43 are parallel with each other, and such that not all three of the axes 27, 31, 43 lie within the same plane. For example, the triangular arrangement may be a non-isosceles right triangular arrangement, such as illustrated in FIG. 19, where it can be seen that a first plane 21 defined by the driver roller and idler roller axes 27, 31, a second plane 23 defined by the idler roller and nose roller axes 31, 43, and a third plane 29 defined by the nose roller and drive roller axes 43, 27 are not co-planar with each other. (That is, any two of the axes 27, 31, 43 will lie in a plane 21, 23, 29, but there is no plane in which all of the axes 27, 31, 43 lie.)

Figure 18:
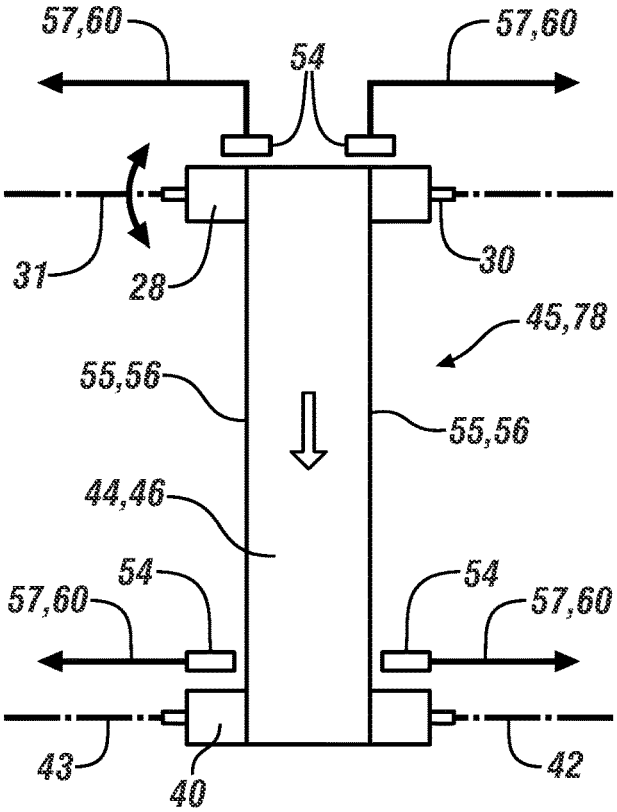

As illustrated in FIG. 18, an optimal running path 78 for the continuous abrasive belt 44 may be defined as a path around the drive roller 24, the idler roller 28 and the nose roller 40 in which the continuous abrasive belt 44 is generally centered across each of the rollers 24, 28, 40. An inner surface 47 of the belt 44 is carried by the rollers 24, 28, 40 and may have a smooth surface, while the outer surface 46 of the belt 44 may be coated with 120-grit diamond particles or other suitable abrasive particles. As shown in FIGS. 8-10, at the top of FIG. 18, and in FIGS. 20-22, the first sensor(s) 54 may be disposed close to the idler roller 28 so as to sense the position 55 of the edge 56 of the continuous abrasive belt 44 proximate the idler roller 28. Or, as shown at the bottom of FIG. 18, the first sensor(s) 54 may be disposed near the edge(s) 56 of the belt 44 proximate the nose roller 40. Each first sensor 54 may optionally be configured as a fiber optic laser sensor 88, or as any suitable type of proximity or position sensor.

Figure 20:
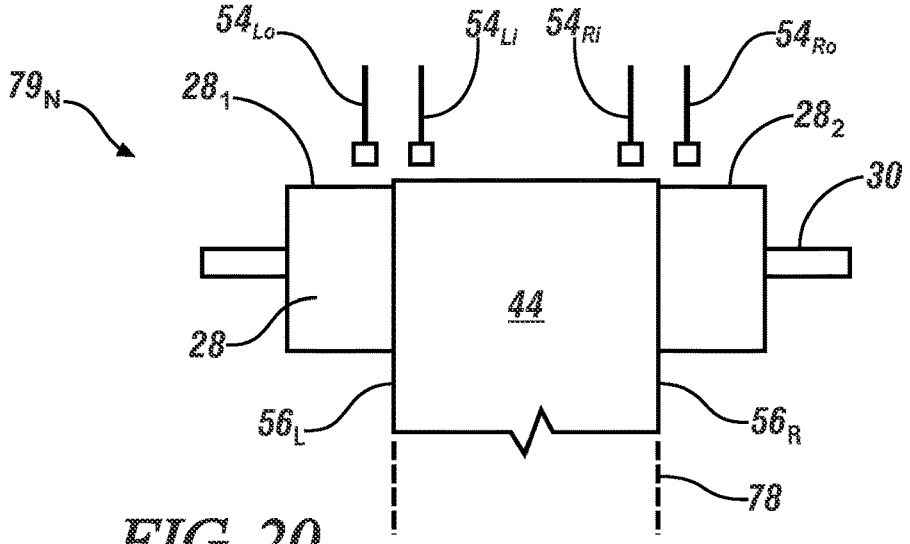
FIGS. 20-22 are schematic front views of an idler roller, continuous abrasive belt and first sensors when the belt is in a normal position, a too-far-left position and a too-far-right position, respectively.

FIGS. 8-10 and 20-22 show an exemplary arrangement of first sensors 54 for sensing the left and right edges 56 of the continuous abrasive belt 44. (Note, however, that the belt 44 is not shown in FIGS. 8-10.) In these drawings, four first sensors 54 are shown: from left to right in the drawings, these are a left outer first sensor $\mathbf{54}_{Lo}$, a left inner first sensor $\mathbf{54}_{Li}$, a right inner first sensor $\mathbf{54}_{Ri}$ and a right outer first sensor $\mathbf{54}_{Ro}$. Each of these first sensors 54 has a respective sensor lead 57; i.e., a left outer first sensor lead $\mathbf{57}_{Lo}$, a left inner first sensor lead $\mathbf{57}_{Li}$, a right inner first sensor lead $\mathbf{57}_{Ri}$ and a right outer first sensor lead $\mathbf{57}_{Ro}$. When the belt sander 20 is in the operating state 45 and the belt 44 is running along its optimal running path 78, the belt 44 will be generally centered across each of the rollers 24, 28, 40 and the pivot arm 32 will be disposed in a level orientation, as is shown in FIGS. 19 and 20. In this condition, the belt 44 is disposed in a normal position $\mathbf{79}_N$, in which the left edge $\mathbf{56}_L$ of the belt 44 is disposed between the left inner and outer first sensors $\mathbf{54}_{Li}$, $\mathbf{54}_{Lo}$, and the right edge $\mathbf{56}_R$ of the belt 44 is between the right inner and outer first sensors $\mathbf{54}_{Ri}$, $\mathbf{54}_{Ro}$. In this normal position $\mathbf{79}_N$, the left and right inner first sensors $\mathbf{54}_{Li}$, $\mathbf{54}_{Ri}$ will detect the presence of the belt 44, while the left and right outer first sensors $\mathbf{54}_{Lo}$, $\mathbf{54}_{Ro}$ will not.

Figure 21:
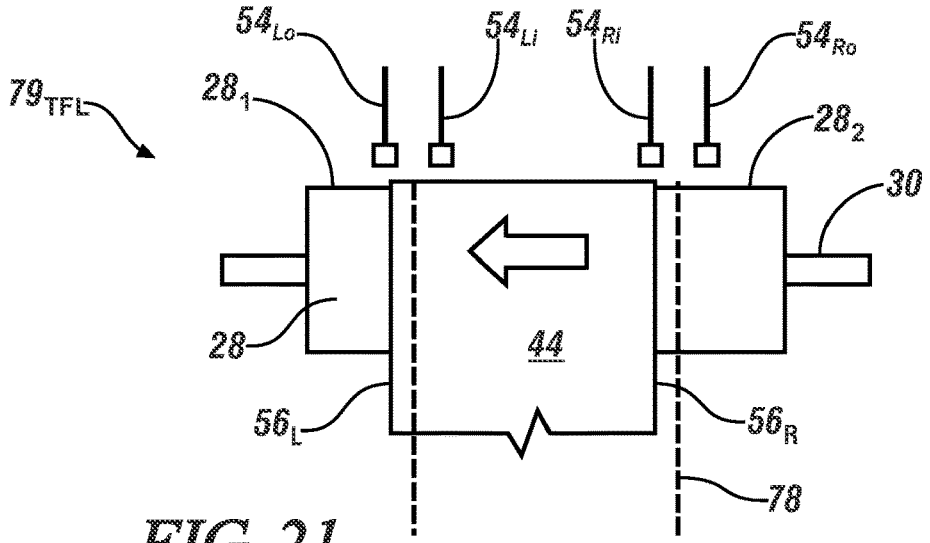
Figure 22:
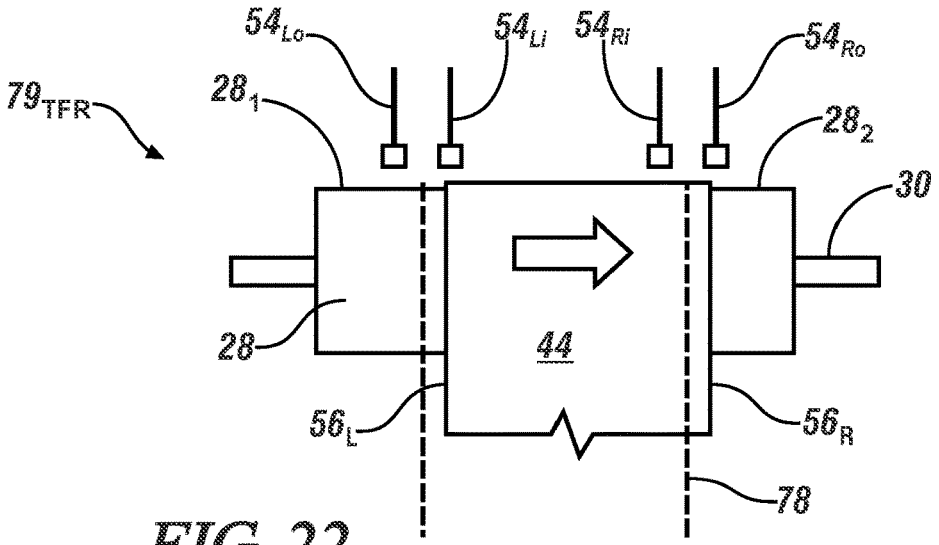

However, when the belt sander 20 is engaged with a workpiece 15, the contours of the workpiece 15, the attack angle 9 between the belt 44 and the surface of the workpiece 15, the pressure of the nose roller 40 against the workpiece 15, and the motion of the belt sander 20 with respect to the workpiece 15 may cause the belt 44 to slip to the left or the right away from the normal position $\mathbf{79}_N$ and optimal running path 78. For example, as shown in FIG. 21, the belt 44 has slipped to the left such that the left outer first sensor $\mathbf{54}_{Lo}$ begins to detect the left edge $\mathbf{56}_L$ of the belt 44 and the right inner first sensor $\mathbf{54}_{Ri}$ begins to no longer detect the right edge $\mathbf{56}_R$ of the belt 44; in this position, the belt is disposed in a too-far-left position $\mathbf{79}_{TFL}$. And as shown in FIG. 22, the belt 44 has slipped to the right such that the right outer first sensor $\mathbf{54}_{Ro}$ begins to detect the right edge $\mathbf{56}_R$ of the belt 44 and the left inner first sensor $\mathbf{54}_{Li}$ begins to no longer detect the left edge $\mathbf{56}_L$ of the belt 44; in this position, the belt is disposed in a too-far-right position $\mathbf{79}_{TFR}$.

When the position of the belt 44 is in either the too-far-left position $\mathbf{79}_{TFL}$ or the too-far-right position $\mathbf{79}_{TFR}$, the first linear actuator 36 may be extended or retracted, respectively, in order to change the first distance $D_1$ and cause the pivot arm 32 to pivot in a direction that causes the belt 44 to move back into the normal position $\mathbf{79}_N$ along the optimal running path 78. Thus, when a too-far-left condition $\mathbf{79}_{TFL}$ is detected (as in FIG. 21), the first linear actuator 36 may be extended so as to expand the first distance $D_1$, thereby causing the pivot arm 32 to pivot about the pivot point 35 in the first pivot direction 80 (e.g., clockwise, as viewed in FIG. 8). This pivoting of the pivot arm 32 (and the idler roller 28 carried thereon) urges the continuous abrasive belt 44 to slip in a first slip direction 82 toward a first idler roller end $\mathbf{28}_1$ of the idler roller 28 (i.e., to the right as viewed in FIG. 8). And contrarily, when a too-far-right condition $\mathbf{79}_{TFR}$ is detected (as in FIG. 22), the first linear actuator 36 may be retracted so as to contract the first distance D1, thereby causing the pivot arm 32 to pivot about the pivot point 35 in the second pivot direction 84 (e.g., counter-clockwise, as viewed in FIG. 9). This pivoting of the pivot arm 32 (and the idler roller 28 carried thereon) urges the continuous abrasive belt 44 to slip in a second slip direction 86 toward a second idler roller end $28_2$ of the idler roller 28 opposite the first idler roller end $28_1$ (i.e., to the left as viewed FIG. 9). Thus, using the pivot arm 32, the one or more first sensors 54 and the first linear actuator 36, the position of the belt 44 may be monitored and corrected as needed so that the normal position $79_N$ and optimal running path 78 may be maintained.

The belt sander 20 may further include at least one second sensor 85 attached to one of the frame 22 and the main body 66 and configured to sense a rotational position of the frame 22 about the cylindrical member 69 (and thus about the cylindrical member axis 65). For example, as shown in FIG. 25, the belt sander 20 may have two second sensors 85 mounted on a flange piece 61 that is attached to and extends outward from the main body 66 of the attachment interface 64. The flange piece 61 may be oriented with respect to the main body 66 such that when the attachment interface 66 and the frame 22 are mated together, the two second sensors 85 may be disposed close to a locating hole 87 formed in the frame 22. The two second sensors 85 and the locating hole 87 may be arranged such that each of the two second sensors 85 may be used to sense the presence or absence of the hole 85 (or the presence or absence of the solid frame 22) right in front of each second sensor 85, so that signals from the two second sensors 85 (indicating the presence or absence of the locating hole 87 or solid frame 22) may be used together to determine the rotational position of the frame 22 about the cylindrical member 69. For instance, if a second sensor 85 produces a "1" signal or a "0" signal to indicate the presence or absence, respectively, of the solid frame 22 right in front of the second sensor 85, then the two second sensors 85 together may produce three distinct sets of signals: (i) "1" and "1" (indicating that both second sensors 85 detect the solid frame 22); (ii) "1" and "0" (indicating that only one of the second sensors 85 detects the solid frame 22); or (iii) "0" and "0" (indicating that neither of the second sensors 85 detects the solid frame 22). Depending on the arrangement and location of the two second sensors 85 with respect to the location of the locating hole 87 (i.e., the location of an edge of the locating hole 87), the signals from the second sensors 85 may be used to determine the rotational position of the frame 22 about the cylindrical member 69. In use of the belt sander 20 to sand or polish the surface of a workpiece 15, the rotational position of the frame 22 may be varied by actuation of the second linear actuator 70, so that the attack angle 9 between the belt 44 and the surface of the workpiece 15 may be varied.

From the foregoing description, it may be seen that belt sander 20 of the present disclosure solves the aforementioned technical problems of linear compliance, radial compliance and belt wander. For example, linear compliance is addressed by the technical effect of the nose roller 40 and the one or more air cylinders 50 used in combination together; radial compliance is addressed by the technical effect of frame 22 being rotatable about the cylindrical member 69 by actuation of the second linear actuator 70; and belt wander is addressed by the technical effect of the first sensor(s) 54, the idler roller 28 being rotatably carried by the pivot arm 32, and the rotation of the pivot arm 32 by actuation of the first linear actuator 36. Thus, these features of the belt sander 20 provide various technical advantages over other approaches.

According to another embodiment, a belt sander 20 includes: an attachment interface 64 having a main body 66 with opposed first and second sides 67, 68, the first side 67 being configured for connection with an end effector 18 of a robot 19 and the second side 68 having a cylindrical member 69 extending outward therefrom; a frame 22 rotatably supported by the cylindrical member 69; a drive roller 24 rotatably supported by a drive roller spindle 26 fixedly or rotatably attached to the frame 22, the drive roller 24 having a drive roller axis 27 about which the drive roller 24 is configured to rotate; an idler roller 28 rotatably supported by an idler roller spindle 30 fixedly or rotatably attached to a pivot arm 32 having opposed first and second pivot arm ends 33, 34, wherein the first pivot arm end 33 is pivotably attached to the frame 22 at a pivot point 35; a first linear actuator 36 having a first end 37 attached to the second pivot arm end 34 and a second end 38 attached to the frame 22, wherein the first linear actuator 36 is configured for expanding a first distance $D_1$ as measured between the first and second ends 37, 38 up to a first maximum length $L_{max1}$ and contracting the first distance $D_1$ down to a first minimum length $L_{min1}$ and for disposition in a first default position 39 in which the first distance $D_1$ is between the first minimum and maximum lengths $L_{min1}$, $L_{max1}$; a nose roller 40 rotatably supported by a nose roller spindle 42 fixedly or rotatably attached to the frame 22; a continuous abrasive belt 44 wrapped around and held in tension by the drive roller 24, the idler roller 28 and the nose roller 40; a drive motor 48 attached to the frame 22 and operatively connected with the drive roller 24 for rotating the drive roller 24 about the drive roller axis 27 and propelling the continuous abrasive belt 44 around the drive roller 24, the idler roller 28 and the nose roller 40 during an operating state 45; an air cylinder 50 having a first air cylinder end 51 attached to the frame 22 and a second air cylinder end 52 attached to the nose roller spindle 42, the air cylinder 50 being configured to exert a first force $F_1$ against the frame 22 and a second force $F_2$ equal to and opposite the first force $F_1$ against the nose roller spindle 42; at least one first sensor 54 attached to the frame 22 and configured to sense a position 55 of an edge 56 of the continuous abrasive belt 44; a first controller 58 operatively connected with the at least one first sensor 54 and the first linear actuator 36 and configured to receive a position signal 60 from the at least one first sensor 54 indicative of the position 55 of the edge 56 of the continuous abrasive belt 44 and to send a command signal 62 responsive to the position signal 60 to the first linear actuator 36 for expanding or contracting the first distance $D_1$ so as to pivot the pivot arm 32 about the pivot point 35; and a second linear actuator 70 having a third end 71 attached to the frame 22 and a fourth end 72 attached to the main body 66, wherein the second linear actuator 70 is configured for expanding a second distance $D_2$ as measured between the third and fourth ends 71, 72 up to a second maximum length $L_{max2}$ and contracting the second distance $D_2$ down to a second minimum length $L_{min2}$.

In this configuration, the expanding of the second distance $D_2$ may cause rotation of the frame 22 about the cylindrical member 69 in a first rotational direction 74, and the contracting of the second distance $D_2$ may cause rotation of the frame 22 about the cylindrical member 69 in a second rotational direction 76 opposite the first rotational direction 74. The idler roller 28 may have an idler roller axis 31 about which the idler roller 28 is configured to rotate, the nose roller 40 may have a nose roller axis 43 about which the nose roller 40 is configured to rotate, and the drive roller axis 27, the idler roller axis 31 and the nose roller axis 43 may be parallel with each other and may not all lie within the same plane. An optimal running path 78 for the continuous abrasive belt 44 may be defined as a path around the drive roller 24, the idler roller 28 and the nose roller 40 in which the continuous abrasive belt 44 is generally centered across each of the drive roller 24, the idler roller 28 and the nose roller 40, and the at least one first sensor 54 may be disposed so as to sense the position 55 of the edge 56 of the continuous abrasive belt 44 proximate the idler roller 28. The expanding of the first distance $D_1$ may cause pivoting of the pivot arm 32 about the pivot point 35 in a first pivot direction 80, which urges the continuous abrasive belt 44 to slip in a first slip direction 82 toward a first idler roller end $\mathbf{28}_1$ of the idler roller 28, and the contracting of the first distance $D_1$ may cause pivoting of the pivot arm 32 about the pivot point 35 in a second pivot direction 84 opposite the first pivot direction 80, which urges the continuous abrasive belt 44 to slip in a second slip direction 86 toward a second idler roller end $\mathbf{28}_2$ of the idler roller 28 opposite the first idler roller end $\mathbf{28}_1$.

According to yet another embodiment, a belt sander 20 includes: an attachment interface 64 having a main body 66 with opposed first and second sides 67, 68, the first side 67 being configured for connection with an end effector 18 of a robot 19 and the second side 68 having a cylindrical member 69 extending outward therefrom; a frame 22 rotatably supported by the cylindrical member 69; a drive roller 24 rotatably supported by a drive roller spindle 26 fixedly or rotatably attached to the frame 22, the drive roller 24 having a drive roller axis 27 about which the drive roller 24 is configured to rotate; an idler roller 28 rotatably supported by an idler roller spindle 30 fixedly or rotatably attached to a pivot arm 32 having opposed first and second pivot arm ends 33, 34, wherein the first pivot arm end 33 is pivotably attached to the frame 22 at a pivot point 35; a first linear actuator 36 having a first end 37 attached to the second pivot arm end 34 and a second end 38 attached to the frame 22, wherein the first linear actuator 36 is configured for expanding a first distance $D_1$ as measured between the first and second ends 37, 38 up to a first maximum length $L_{max1}$ and contracting the first distance $D_1$ down to a first minimum length $L_{min1}$ and for disposition in a first default position 39 in which the first distance $D_1$ is between the first minimum and maximum lengths $L_{min1}$, $L_{max1}$, wherein the expanding of the first distance $D_1$ causes pivoting of the pivot arm 32 about the pivot point 35 in a first pivot direction 80, which urges the continuous abrasive belt 44 to slip in a first slip direction 82 toward a first idler roller end $\mathbf{28}_1$ of the idler roller 28, and the contracting of the first distance $D_1$ causes pivoting of the pivot arm 32 about the pivot point 35 in a second pivot direction 84 opposite the first pivot direction 80, which urges the continuous abrasive belt 44 to slip in a second slip direction 86 toward a second idler roller end $\mathbf{28}_2$ of the idler roller 28 opposite the first idler roller end $\mathbf{28}_1$; a nose roller 40 rotatably supported by a nose roller spindle 42 fixedly or rotatably attached to the frame 22; and a continuous abrasive belt wrapped 44 around and held in tension by the drive roller 24, the idler roller 28 and the nose roller 40.

A drive motor 48 is attached to the frame 22 and is operatively connected with the drive roller 24 for rotating the drive roller 24 about the drive roller axis 27 and propelling the continuous abrasive belt 44 around the drive roller 24, the idler roller 28 and the nose roller 40 during an operating state 45. An air cylinder 50 has a first air cylinder end 52 attached to the frame 22 and a second air cylinder end 52 attached to the nose roller spindle 42, the air cylinder 50 being configured to exert a first force $F_1$ against the frame 22 and a second force $F_2$ equal to and opposite the first force $F_1$ against the nose roller spindle 42. At least one first sensor 54 is attached to the frame 22 and is configured to sense a position 55 of an edge 56 of the continuous abrasive belt 44. A first controller 58 is operatively connected with the at least one first sensor 54 and the first linear actuator 36 and is configured to receive a position signal 60 from the at least one first sensor 54 indicative of the position 55 of the edge 56 of the continuous abrasive belt 44 and to send a command signal 62 responsive to the position signal 60 to the first linear actuator 36 for expanding or contracting the first distance $D_1$ so as to pivot the pivot arm 32 about the pivot point 35. A second linear actuator 70 has a third end 71 attached to the frame 22 and a fourth end 72 attached to the main body 66, wherein the second linear actuator 70 is configured for expanding a second distance $D_2$ as measured between the third and fourth ends 71, 72 up to a second maximum length $L_{max2}$ and contracting the second distance $D_2$ down to a second minimum length $L_{min2}$, wherein the expanding of the second distance $D_2$ causes rotation of the frame 22 about the cylindrical member 69 in a first rotational direction 74, and the contracting of the second distance $D_2$ causes rotation of the frame 22 about the cylindrical member 69 in a second rotational direction 76 opposite the first rotational direction 74.

The idler roller 28 may have an idler roller axis 31 about which the idler roller 28 is configured to rotate, the nose roller 40 may have a nose roller axis 43 about which the nose roller 40 is configured to rotate, and the drive roller axis 27, the idler roller axis 31 and the nose roller axis 43 may be parallel with each other and may not all lie within the same plane. An optimal running path 78 for the continuous abrasive belt 44 may be defined as a path around the drive roller 24, the idler roller 28 and the nose roller 40 in which the continuous abrasive belt 44 is generally centered across each of the drive roller 24, the idler roller 28 and the nose roller 40, and the at least one first sensor 54 may be disposed so as to sense the position 55 of the edge 56 of the continuous abrasive belt 44 proximate the idler roller 28.

The above description is intended to be illustrative, and not restrictive. While the dimensions and types of materials described herein are intended to be illustrative, they are by no means limiting and are exemplary embodiments. In the following claims, use of the terms "first", "second", "top", "bottom", etc. are used merely as labels, and are not intended to impose numerical or positional requirements on their objects. As used herein, an element or step recited in the singular and preceded by the word "a" or "an" should be understood as not excluding plural of such elements or steps, unless such exclusion is explicitly stated. Additionally, the phrase "at least one of A and B" and the phrase "A and/or B" should each be understood to mean "only A, only B, or both A and B". Moreover, unless explicitly stated to the contrary, embodiments "comprising" or "having" an element or a plurality of elements having a particular property may include additional such elements not having that property. And when broadly descriptive adverbs such as "substantially" and "generally" are used herein to modify an adjective, these adverbs mean "for the most part", "to a significant extent" and/or "to a large degree", and do not necessarily mean "perfectly", "completely", "strictly" or "entirely". Additionally, the word "proximate" may be used herein to describe the location of an object or portion thereof with respect to another object or portion thereof, and/or to describe the positional relationship of two objects or their respective portions thereof with respect to each other, and may mean "near", "adjacent", "close to", "close by", "at" or the like.

This written description uses examples, including the best mode, to enable those skilled in the art to make and use devices, systems and compositions of matter, and to perform methods, according to this disclosure. It is the following claims, including equivalents, which define the scope of the present disclosure.

What is claimed is:

1. A belt sander, comprising:

a frame;

a drive roller rotatably supported by a drive roller spindle fixedly or rotatably attached to the frame, the drive roller having a drive roller axis about which the drive roller is configured to rotate;

an idler roller rotatably supported by an idler roller spindle fixedly or rotatably attached to a pivot arm having opposed first and second pivot arm ends, wherein the first pivot arm end is pivotably attached to the frame at a pivot point;

a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths;

a nose roller rotatably supported by a nose roller spindle fixedly or rotatably attached to the frame;

a continuous abrasive belt wrapped around and held in tension by the drive roller, the idler roller and the nose roller;

a drive motor attached to the frame and operatively connected with the drive roller for rotating the drive roller about the drive roller axis and propelling the continuous abrasive belt around the drive roller, the idler roller and the nose roller during an operating state;

an air cylinder having a first air cylinder end attached to the frame and a second air cylinder end attached to the nose roller spindle, the air cylinder being configured to exert a first force against the frame and a second force equal to and opposite the first force against the nose roller spindle;

at least one first sensor attached to the frame and configured to sense a position of an edge of the continuous abrasive belt; and a first controller operatively connected with the at least one first sensor and the first linear actuator and configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point.

2. A belt sander according to claim 1, further comprising:

an attachment interface having a main body with opposed first and second sides, the first side being configured for connection with an end effector of a robot and the second side having a cylindrical member extending outward therefrom and rotatably supporting the frame; and a second linear actuator having a third end attached to the frame and a fourth end attached to the main body, wherein the second linear actuator is configured for expanding a second distance as measured between the third and fourth ends up to a second maximum length and contracting the second distance down to a second minimum length.

3. A belt sander according to claim 2, wherein the expanding of the second distance causes rotation of the frame about the cylindrical member in a first rotational direction, and the contracting of the second distance causes rotation of the frame about the cylindrical member in a second rotational direction opposite the first rotational direction.

4. A belt sander according to claim 1, wherein the idler roller has an idler roller axis about which the idler roller is configured to rotate, the nose roller has a nose roller axis about which the nose roller is configured to rotate, and the drive roller axis, the idler roller axis and the nose roller axis are parallel with each other and do not all lie within the same plane.

5. A belt sander according to claim 1, wherein an optimal running path for the continuous abrasive belt is defined as a path around the drive roller, the idler roller and the nose roller in which the continuous abrasive belt is generally centered across each of the drive roller, the idler roller and the nose roller.

6. A belt sander according to claim 1, wherein the expanding of the first distance causes pivoting of the pivot arm about the pivot point in a first pivot direction, which urges the continuous abrasive belt to slip in a first slip direction toward a first idler roller end of the idler roller, and the contracting of the first distance causes pivoting of the pivot arm about the pivot point in a second pivot direction opposite the first pivot direction, which urges the continuous abrasive belt to slip in a second slip direction toward a second idler roller end of the idler roller opposite the first idler roller end.

7. A belt sander according to claim 1, wherein the at least one first sensor is disposed so as to sense the position of the edge of the continuous abrasive belt proximate the idler roller.

8. A belt sander according to claim 1, wherein the at least one first sensor is at least one fiber optic laser sensor.

9. A belt sander according to claim 1, wherein an outer surface of the abrasive belt is coated with 120-grit diamond particles.

10. A belt sander according to claim 1, further comprising:

a lubricant dispenser attached to the frame and configured to spray a lubricant onto an outer surface of the continuous abrasive belt.

11. A belt sander, comprising:

an attachment interface having a main body with opposed first and second sides, the first side being configured for connection with an end effector of a robot and the second side having a cylindrical member extending outward therefrom;

a frame rotatably supported by the cylindrical member;

a drive roller rotatably supported by a drive roller spindle fixedly or rotatably attached to the frame, the drive roller having a drive roller axis about which the drive roller is configured to rotate;

an idler roller rotatably supported by an idler roller spindle fixedly or rotatably attached to a pivot arm having opposed first and second pivot arm ends, wherein the first pivot arm end is pivotably attached to the frame at a pivot point;

a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths;

a nose roller rotatably supported by a nose roller spindle fixedly or rotatably attached to the frame;

a continuous abrasive belt wrapped around and held in tension by the drive roller, the idler roller and the nose roller;

a drive motor attached to the frame and operatively connected with the drive roller for rotating the drive roller about the drive roller axis and propelling the continuous abrasive belt around the drive roller, the idler roller and the nose roller during an operating state;

an air cylinder having a first air cylinder end attached to the frame and a second air cylinder end attached to the nose roller spindle, the air cylinder being configured to exert a first force against the frame and a second force equal to and opposite the first force against the nose roller spindle;

at least one first sensor attached to the frame and configured to sense a position of an edge of the continuous abrasive belt;

a first controller operatively connected with the at least one first sensor and the first linear actuator and configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point; and a second linear actuator having a third end attached to the frame and a fourth end attached to the main body, wherein the second linear actuator is configured for expanding a second distance as measured between the third and fourth ends up to a second maximum length and contracting the second distance down to a second minimum length.

12. A belt sander according to claim 11, wherein the expanding of the second distance causes rotation of the frame about the cylindrical member in a first rotational direction, and the contracting of the second distance causes rotation of the frame about the cylindrical member in a second rotational direction opposite the first rotational direction.

13. A belt sander according to claim 11, wherein the idler roller has an idler roller axis about which the idler roller is configured to rotate, the nose roller has a nose roller axis about which the nose roller is configured to rotate, and the drive roller axis, the idler roller axis and the nose roller axis are parallel with each other and do not all lie within the same plane.

14. A belt sander according to claim 11, wherein an optimal running path for the continuous abrasive belt is defined as a path around the drive roller, the idler roller and the nose roller in which the continuous abrasive belt is generally centered across each of the drive roller, the idler roller and the nose roller.

15. A belt sander according to claim 11, wherein the expanding of the first distance causes pivoting of the pivot arm about the pivot point in a first pivot direction, which urges the continuous abrasive belt to slip in a first slip direction toward a first idler roller end of the idler roller, and the contracting of the first distance causes pivoting of the pivot arm about the pivot point in a second pivot direction opposite the first pivot direction, which urges the continuous abrasive belt to slip in a second slip direction toward a second idler roller end of the idler roller opposite the first idler roller end.

16. A belt sander according to claim 11, wherein the at least one first sensor is disposed so as to sense the position of the edge of the continuous abrasive belt proximate the idler roller.

17. A belt sander, comprising:

an attachment interface having a main body with opposed first and second sides, the first side being configured for connection with an end effector of a robot and the second side having a cylindrical member extending outward therefrom;

a frame rotatably supported by the cylindrical member;

a drive roller rotatably supported by a drive roller spindle fixedly or rotatably attached to the frame, the drive roller having a drive roller axis about which the drive roller is configured to rotate;

an idler roller rotatably supported by an idler roller spindle fixedly or rotatably attached to a pivot arm having opposed first and second pivot arm ends, wherein the first pivot arm end is pivotably attached to the frame at a pivot point;

a first linear actuator having a first end attached to the second pivot arm end and a second end attached to the frame, wherein the first linear actuator is configured for expanding a first distance as measured between the first and second ends up to a first maximum length and contracting the first distance down to a first minimum length and for disposition in a first default position in which the first distance is between the first minimum and maximum lengths, wherein the expanding of the first distance causes pivoting of the pivot arm about the pivot point in a first pivot direction, which urges the continuous abrasive belt to slip in a first slip direction toward a first idler roller end of the idler roller, and the contracting of the first distance causes pivoting of the pivot arm about the pivot point in a second pivot direction opposite the first pivot direction, which urges the continuous abrasive belt to slip in a second slip direction toward a second idler roller end of the idler roller opposite the first idler roller end;

a nose roller rotatably supported by a nose roller spindle fixedly or rotatably attached to the frame;

a continuous abrasive belt wrapped around and held in tension by the drive roller, the idler roller and the nose roller;

a drive motor attached to the frame and operatively connected with the drive roller for rotating the drive roller about the drive roller axis and propelling the continuous abrasive belt around the drive roller, the idler roller and the nose roller during an operating state;

an air cylinder having a first air cylinder end attached to the frame and a second air cylinder end attached to the nose roller spindle, the air cylinder being configured to exert a first force against the frame and a second force equal to and opposite the first force against the nose roller spindle;

at least one first sensor attached to the frame and configured to sense a position of an edge of the continuous abrasive belt;

a first controller operatively connected with the at least one first sensor and the first linear actuator and configured to receive a position signal from the at least one first sensor indicative of the position of the edge of the continuous abrasive belt and to send a command signal responsive to the position signal to the first linear actuator for expanding or contracting the first distance so as to pivot the pivot arm about the pivot point; and a second linear actuator having a third end attached to the frame and a fourth end attached to the main body, wherein the second linear actuator is configured for expanding a second distance as measured between the third and fourth ends up to a second maximum length and contracting the second distance down to a second minimum length, wherein the expanding of the second distance causes rotation of the frame about the cylindrical member in a first rotational direction, and the contracting of the second distance causes rotation of the frame about the cylindrical member in a second rotational direction opposite the first rotational direction.

18. A belt sander according to claim 17, wherein the idler roller has an idler roller axis about which the idler roller is configured to rotate, the nose roller has a nose roller axis about which the nose roller is configured to rotate, and the drive roller axis, the idler roller axis and the nose roller axis are parallel with each other and do not all lie within the same plane.

19. A belt sander according to claim 17, wherein an optimal running path for the continuous abrasive belt is defined as a path around the drive roller, the idler roller and the nose roller in which the continuous abrasive belt is generally centered across each of the drive roller, the idler roller and the nose roller.

20. A belt sander according to claim 17, wherein the at least one first sensor is disposed so as to sense the position of the edge of the continuous abrasive belt proximate the idler roller.

* * * * *